US012228132B2

(12) United States Patent
Jang

(10) Patent No.: US 12,228,132 B2
(45) Date of Patent: Feb. 18, 2025

(54) VARIABLE DISPLACEMENT GEROTOR PUMP

(71) Applicant: Soon Gil Jang, Seoul (KR)

(72) Inventor: Soon Gil Jang, Seoul (KR)

( * ) Notice: Subject to any disclaimer, the term of this patent is extended or adjusted under 35 U.S.C. 154(b) by 0 days.

(21) Appl. No.: 18/302,145

(22) Filed: Apr. 18, 2023

(65) Prior Publication Data

US 2023/0250819 A1 Aug. 10, 2023

Related U.S. Application Data

(63) Continuation-in-part of application No. 17/211,015, filed on Mar. 24, 2021, now abandoned.

(30) Foreign Application Priority Data

Mar. 24, 2020 (KR) ..... 10-2020-0035317
Mar. 25, 2020 (KR) ..... 10-2020-0036223
(Continued)

(51) Int. Cl.
*F04C 2/10* (2006.01)
*F01C 21/10* (2006.01)
(Continued)

(52) U.S. Cl.
CPC ..... *F04C 2/104* (2013.01); *F04C 15/0076* (2013.01); *F04C 15/06* (2013.01);
(Continued)

(58) Field of Classification Search
CPC ..... F04C 2/104; F04C 15/0076; F04C 15/06; F04C 2240/60; F04C 14/185; F04C 2/103;
(Continued)

(56) References Cited

U.S. PATENT DOCUMENTS 4,265,135 A 5/1981 Smirl
4,740,142 A 4/1988 Rohs et al.
(Continued)

FOREIGN PATENT DOCUMENTS

JP 2010001742 A 1/2010
KR 10-2007-0091150 A 9/2007
(Continued)

OTHER PUBLICATIONS

English Machine Translation of WO2014178483A1 translated via USPTO Fit database (Year: 2014).*
(Continued)

*Primary Examiner* — Dominick L Plakkoottam
*Assistant Examiner* — Paul W Thiede
(74) *Attorney, Agent, or Firm* — NKL Law; Jae Youn Kim

(57) ABSTRACT

The movement of the moving gear meshed with the fixed gear in the casing changes the meshing width of the two gears, thereby changing the discharge amount of the pump. By installing a gear block inside the fixed gear, which is an internal gear, and a gear ring and gear ring cover on the outside of the moving gear, the fluid between the two gears is prevented from leaking to the outside. The fluid can pass between the two gears from or to the outside through the fluid holes in the fixed gear and the fluid inlets in the pumping chamber in the casing. The part of the fixed gear that is not engaged with the moving gear can be used as a hydraulic chamber.

2 Claims, 18 Drawing Sheets

(30) Foreign Application Priority Data

| | | |
|---|---|---|
| Apr. 10, 2020 | (KR) | 10-2020-0043812 |
| May 6, 2020 | (KR) | 10-2020-0053619 |
| Dec. 5, 2020 | (KR) | 10-2020-0169039 |

(51) Int. Cl.

| | |
|---|---|
| ***F04C 2/14*** | (2006.01) |
| ***F04C 2/18*** | (2006.01) |
| ***F04C 2/22*** | (2006.01) |
| ***F04C 15/00*** | (2006.01) |
| ***F04C 15/06*** | (2006.01) |

(52) U.S. Cl.
CPC ..... *F01C 21/10* (2013.01); *F01C 21/108* (2013.01); *F04C 2/10* (2013.01); *F04C 2/14* (2013.01); *F04C 2/18* (2013.01); *F04C 2/22* (2013.01); *F04C 2240/60* (2013.01)

(58) Field of Classification Search
CPC ..... F04C 2/10; F04C 2/14; F04C 2/18; F04C 2/22; F01C 21/10; F01C 21/108
See application file for complete search history.

(56) References Cited

U.S. PATENT DOCUMENTS

| | | | | |
|---|---|---|---|---|
| 7,832,997 | B2 | 11/2010 | Williamson et al. | |
| 8,684,702 | B2 | 4/2014 | Watanabe et al. | |
| 9,133,842 | B2 | 9/2015 | Watanabe et al. | |
| RE46,294 | E | 1/2017 | Watanabe et al. | |
| 9,835,153 | B2 | 12/2017 | Tsuge et al. | |
| 9,850,898 | B2 | 12/2017 | Moetakef | |
| 9,903,367 | B2 | 2/2018 | Watanabe et al. | |
| 10,161,398 | B2 | 12/2018 | Saga | |
| 10,344,759 | B2 | 7/2019 | Yamamoto et al. | |
| 2001/0024618 | A1 | 9/2001 | Winmill | |
| 2002/0076344 | A1 * | 6/2002 | Clarke | F04C 2/101 418/21 |
| 2018/0223839 | A1 | 8/2018 | Jang | |
| 2020/0141406 | A1 | 5/2020 | Jang | |

FOREIGN PATENT DOCUMENTS

| | | | | |
|---|---|---|---|---|
| KR | 10-2014-0140011 | A | 12/2014 | |
| KR | 1020147006597 | A | 12/2014 | |
| KR | 1020150136436 | A | 12/2015 | |
| KR | 10-2017-0020197 | A | 2/2017 | |
| KR | 10-2003107 | B1 | 7/2019 | |
| WO | WO-2014178483 | A1 * | 11/2014 | F04C 14/185 |

OTHER PUBLICATIONS

Bibliographic Page of KR102003107B1 shown equivalence to US2018223839A1 (Year: 2019).

* cited by examiner

VARIABLE DISPLACEMENT GEROTOR PUMP

CROSS-REFERENCE TO RELATED APPLICATIONS

This application is a continuation in part application of U.S. patent application Ser. No. 17/211,015 filed on Mar. 24, 2021, which claims priority under 35 U.S.C § 119 to Korean Patent Application Nos. 10-2020-0035317, 10-2020-0036223, 10-2020-0043812, 10-2020-0053619 and 10-2020-0169039, filed in the Korean Intellectual Property Office on Mar. 24, 2020, Mar. 25, 2020, Apr. 10, 2020, May 6, 2020, and Dec. 5, 2020, respectively, the entire contents of which are hereby incorporated by reference.

TECHNICAL FIELD

The present disclosure relates to a variable displacement gerotor pump, and more particularly, to a variable displacement gerotor pump in which a meshing width of gears can be adjusted so as to adjust a discharge per rotation.

BACKGROUND ART

A gerotor pump, which is also referred to as a trochoid pump, generally generates a fluid flow with gears that are repeatedly meshed with and separated from each other and provides a flow rate that is proportional to a meshing width of the gears. According to this configuration, a change of the meshing width of an internal gear and an outer gear in the gerotor pump can change a fluid discharge rate per rotation. For example, changing the meshing width of the gears can be achieved by moving the two gears in opposite directions in an axial direction.

Meanwhile, a hydraulic pump or a hydraulic motor can be implemented using vanes, pistons, gears, or the like, and have different characteristics according to their configurations. In particular, although the hydraulic pump and the hydraulic motor using gears have a very simple structure, there are many difficulties in manufacturing them as a variable displacement type. In general, a variable displacement pump has a problem of difficulty of manufacture and repair due to its complicated structure, thereby increasing manufacturing cost and maintenance cost.

SUMMARY

An object of the present disclosure is to provide a variable displacement gerotor pump in which a meshing width of gears is changed by moving the gears in an axial direction. This simplifies the structure of the variable displacement gerotor pump without causing a fluid leak. According to this configuration, the simple structure and characteristics of the gerotor pump can be maintained even in the variable displacement gerotor pump. In addition, the configuration of the variable displacement gerotor pump can also be applied to the manufacture of a variable displacement gerotor motor.

Another object of the present disclosure is to provide a variable displacement gerotor pump capable of maintaining a hydraulic pressure of a discharge pumping chamber and a discharge per unit time within a certain range regardless of a rotational speed of a shaft that drives the pump. The variable displacement gerotor pump having such a configuration can be used by being connected to a shaft where the speed is fluctuated frequently and rapidly, such as a crankshaft of an automobile.

According to an embodiment of the present disclosure, a variable displacement gerotor pump includes a casing including a pumping chamber having one or more fluid inlets, a fixed gear being inserted into the casing and rotating at a fixed position, having a shape of a cylinder, including a plurality of teeth formed inside the cylinder, and including at least one fluid hole at one end of the cylinder to allow a fluid to flow from the pumping chamber or into the pumping chamber, a moving gear provided inside the fixed gear and in mesh with the fixed gear and movable in an axial direction, the moving gear including one less number of teeth than a number of the plurality of teeth of the fixed gear, a gear block arranged inside the fixed gear, the gear block being in contact with one end of the moving gear and movable in the axial direction, a gear ring arranged outside the moving gear, in which the moving gear can be movable with respect to the gear ring in the axial direction, and a gear ring cover provided at one end of the casing and including a hole in which the gear ring is rotated.

According to an embodiment, in the variable displacement gerotor pump, one end of the fixed gear may be in contact with the gear ring cover and the gear ring, and the one end of the moving gear may be in contact with the gear block, and the other end of the moving gear may be disposed through the gear ring.

According to an embodiment, the variable displacement gerotor pump may further include a gear block bolt, a moving gear sleeve, or a moving gear common shaft configured to allow the gear block to be rotated from a contact surface between the moving gear and the gear block, and the moving gear and the gear block are movable together in the axial direction.

According to an embodiment, the variable displacement gerotor pump may further include a moving gear common shaft inserted through a moving gear hole formed in a central portion of the moving gear and including a sleeve provided on at least one end of the moving gear, and a moving gear shaft inserted through a hole formed in a central portion of the moving gear common shaft.

According to an embodiment, the variable displacement gerotor pump may further include a moving gear shaft support provided outside the gear ring cover to fix and support at least one end of the moving gear shaft.

According to an embodiment, the variable displacement gerotor pump may include a driving flange connected to the fixed gear and configured to rotate the fixed gear.

According to an embodiment, the variable displacement gerotor pump may further include a hydraulic chamber inside the casing, having one side formed on another side of the gear block in contact with the moving gear, and a fluid connection passage configured to allow the fluid that flows into the pumping chamber to be moved to the hydraulic chamber.

According to an embodiment, the variable displacement gerotor pump may further include a spring having a restoring force capable of balancing a force with respect to a force applied on the gear block in the hydraulic chamber.

According to an embodiment, the variable displacement gerotor pump may further include a spring support capable of fixing the spring.

According to another embodiment of the present disclosure, a variable displacement gerotor pump includes a casing including a plurality of pumping chambers, each of the plurality of pumping chambers having one or more fluid inlets, a fixed gear being inserted into the casing and rotating at a fixed position, having a shape of a cylinder, including a plurality of teeth formed inside the cylinder, and including at least one fluid hole at both ends of the cylinder to allow a fluid to flow from the plurality of pumping chambers or into the plurality of pumping chambers, two moving gears provided inside the fixed gear and in mesh with the fixed gear and movable in an axial direction, each of the two moving gears including one less number of teeth than a number of teeth of the fixed gear, a gear block arranged inside the fixed gear and provided between the two moving gears and movable in the axial direction, two gear rings arranged outside the two moving gears, in which the two moving gears can be movable with respect to each of the two gear rings in the axial direction, and two gear ring covers provided at both ends of the casing, respectively, and including holes in which the two gear rings are rotated respectively.

According to an embodiment of the present disclosure, since it is possible to implement a variable displacement gerotor pump or a variable displacement gerotor motor through minimal changes to a simple structure of a general gerotor pump or a gerotor motor, it is easy to manufacture and maintain the variable displacement gerotor pump or motor, and provide economical pump due to low cost.

According to an embodiment of the present disclosure, the embodiment may be used alone as the variable displacement gerotor pump and the variable displacement gerotor motor. In addition, the embodiment is applicable to various fields by connecting the variable displacement gerotor pump and the variable displacement gerotor motor to a continuously variable transmission of an automobile, a continuously variable power distribution device, and the like. Particularly, in the variable displacement gerotor pump according to the embodiments of the present disclosure, the discharge per rotation is proportional to the meshing width of the gears. Accordingly, according to the present disclosure, the variable displacement gerotor pump having a large discharge per rotation can be manufactured by adjusting the meshing width of the gears.

According to an embodiment of the present disclosure, the variable displacement gerotor pump is capable of changing the discharge per rotation in a variety of ranges including a value of 0, and does not incur a mechanical burden caused by a large change in the discharge per rotation. Accordingly, the variable displacement gerotor pump of the present disclosure can be effectively used for various purposes including environments in which the discharge per rotation or the hydraulic pressure varies greatly.

According to an embodiment of the present disclosure, since it is possible to maintain the hydraulic pressure and the discharge per unit time of the pumping chamber that discharges within a certain range regardless of the rotational speed of the shaft driving the pump with a simple structural change, when it is used in an environment such as an automobile, it is possible to properly maintain the hydraulic pressure of the discharge pumping chamber and the discharge per unit time even at low speeds.

According to an embodiment of the present disclosure, since it is possible to prevent excessively high hydraulic pressure or an increase in the discharge per unit time even at a high speed, it is possible to reduce unnecessary waste of energy without exerting an excessive burden on the machine.

DESCRIPTION

Brief Description of the Drawing

Embodiments of the present disclosure will be described with reference to the accompanying drawings described below, where similar reference numerals indicate similar elements, but are not limited thereto, in which.

DETAILED DESCRIPTION

Figure 1:
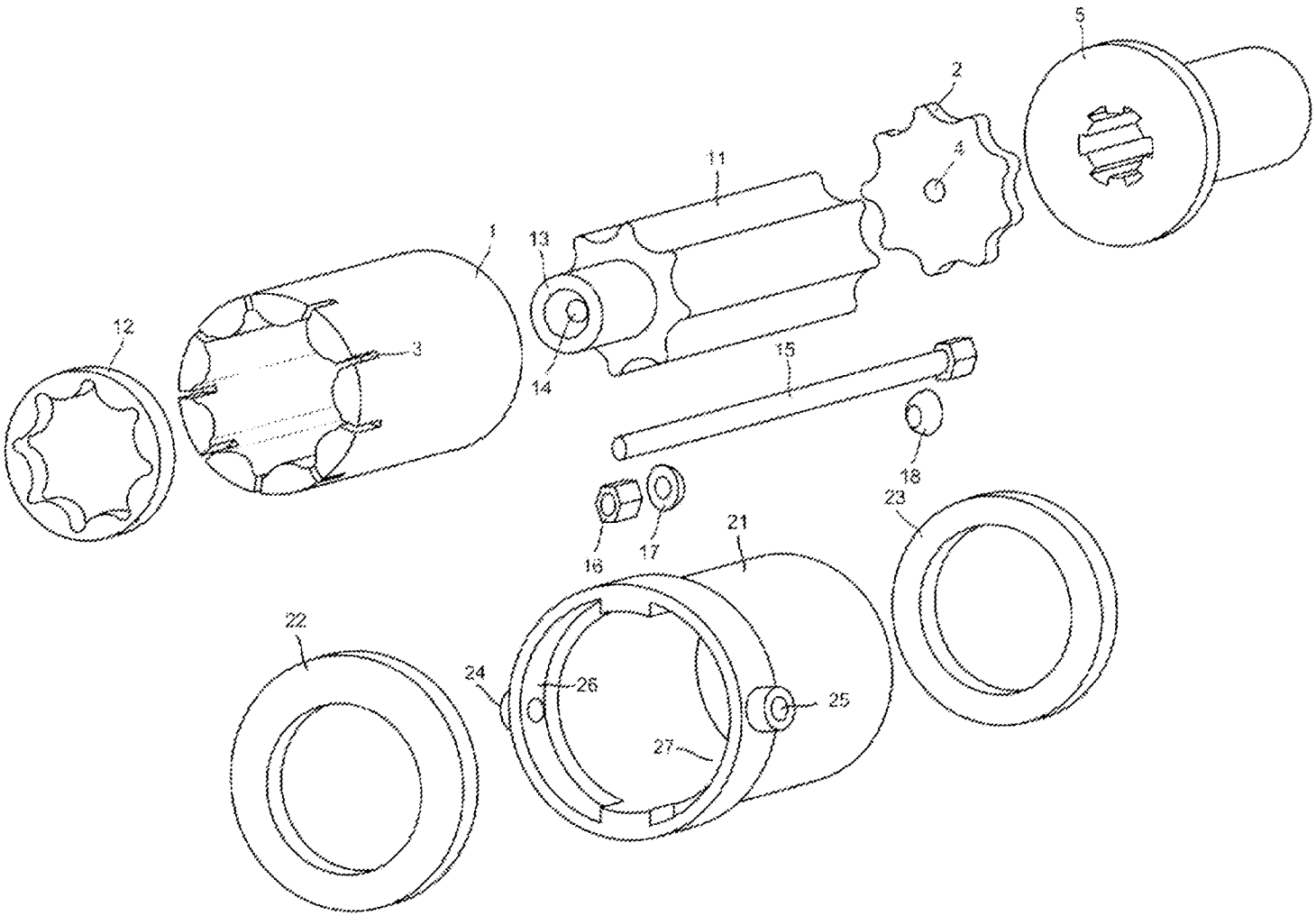
FIG. 1 is an exploded perspective view of the variable displacement gerotor pump according to an embodiment.

Hereinafter, a variable displacement gerotor pump or motor according to various embodiments of the present disclosure will be described with reference to the accompanying drawings. However, in the following description, detailed descriptions of well-known functions or configurations will be omitted when it may make the subject matter of the present disclosure rather unclear.

In the accompanying drawings, the same or corresponding elements are assigned the same reference numerals. In addition, in the following description of the embodiments, duplicate descriptions of the same or corresponding elements may be omitted. However, even if descriptions of elements are omitted, it is not intended that such elements are not included in any embodiment.

In the variable displacement gerotor pump or motor according to various embodiments of the present disclosure, a shape of a central shaft, and/or a device or a component for maintaining connection between a moving gear and a gear block may be interchangeably applied and combined in various ways.

In the following description of the embodiments of the present disclosure, the variable displacement gerotor pump and the variable displacement gerotor motor may have the same or similar structure. Accordingly, the description of the structure of a variable displacement gerotor pump according to some embodiments may be applied to a variable displacement gerotor motor including the same components or structure.

FIG. 1 is an exploded perspective view of the variable displacement gerotor pump according to an embodiment. As shown, the variable displacement gerotor pump may include a fixed gear 1, a gear block 2, a drive flange 5, a moving gear 11, a gear ring 12, a moving gear shaft 13, a gear block bolt 15, a nut 16, spherical washers 17, 18, a casing 21, a gear ring cover 22, and a casing cover 23.

The fixed gear 1 may be an internal gear and include a plurality of fluid holes 3 formed at one end. The drive flange 5 may be connected to the fixed gear 1 and serve to rotate the fixed gear 1. The moving gear 11 can be moved inside the gear ring 12 in the axial direction without a fluid leak, and the gear ring 12 can be rotated in a hole of the gear ring cover 22 without a fluid leak, not being moved out, remained in a fixed position. The gear block 2 can be moved within the fixed gear 1 in the axial direction without a fluid leak, and moved in contact with one side of the moving gear 11 in the axial direction without a fluid leak.

The shapes of tooth of the fixed gear 1 and the moving gear 11 are not limited to the shapes shown in FIG. 1, and various tooth used in the related gerotor pump may be used. The fixed gear 1 may be an internal gear, and the moving gear 11 may be located within the fixed gear 1. In this case, the number of teeth of the moving gear 11 may be one less than the number of teeth of the fixed gear 1.

The fixed gear 1 and the moving gear 11 may be rotatable within the casing 21, with the tooth of both gears being engaged and without having a fluid leak between the engaged teeth. The fixed gear 1 can be rotated within the casing 21 without a fluid leak. In this case, the fixed gear 1 may be limited in motion in the axial direction. Meanwhile, the moving gear 11 may be moved in the axial direction. One end of the fixed gear 1 may be in contact with the drive flange 5, and the other end may be in contact with the gear ring 12 and the gear ring cover 22 to allow rotation without a fluid leak. One end of the moving gear 11 may be in contact with the gear block 2 to allow rotation without a fluid leak, and the other end of the moving gear 11 may pass through the gear ring 12. The gear block 2 may be moved within the fixed gear 1 in the axial direction without a fluid leak.

The fixed gear 1 may include one or more fluid holes 3 formed at one end thereof. The fluid holes 3 may serve as a passage through which fluid may be moved, between the interior of the fixed gear 1 and pumping chambers 26, 27 of the casing 21. The thickness of the gear block 2 may be greater than or equal to the depth of the fluid holes 3.

The moving gear 11 can be moved inside the gear ring 12 in the axial direction without a fluid leak, and the gear ring 12 can be rotated in contact with the inner surface of the hole of the gear ring cover 22 without a fluid leak, not being moved out, remained in a fixed position.

At one end of the casing 21, the pumping chambers 26, 27 are formed on one and the other sides, respectively, and fluid inlets 24, 25 connected to the outside of the casing 21 may be located in each of the pumping chambers 26, 27. Meanwhile, FIG. 1 illustrates two pumping chambers 26, 27 and two fluid inlets 24, 25 formed in the casing 21, but embodiments are not limited thereto, and there may be provided a single, or three or more pumping chambers 26, 27 and fluid inlets 24, 25.

According to an embodiment, when the casing 21 is used while being immersed in the fluid, one pumping chamber 26, 27 may be sufficient, and the other may be open. In this case, the tank containing the fluid may serve as an additional pumping chamber. The gear ring cover 22 may be provided on the casing 21 at a side where the fluid inlets 24, 25 are located. The casing cover 23 may be provided opposite the gear ring cover.

The gear block bolt 15 may pass through a bolt hole 14 in the moving gear shaft 13 located at one side of the moving gear 11 and a gear block hole 4 in the gear block 2. In this case, the nut 16 and the spherical washers 17, 18 may allow the gear block 2 to be rotated without having fluid leaking from the contact surfaces of the moving gear 11 and the gear block 2. In addition, the distance between the moving gear 11 and the gear block 2 may be adjusted so that they can be moved together in the axial direction. Although it is shown that the gear block bolt 15, the nut 16 and the spherical washers 17, 18 are used for the contact and movement in the axial direction of the moving gear 11 and the gear block 2, embodiments are not limited thereto. For example, the moving gear shaft 13 and the gear block 2 may be brought into contact with each other using a clamp-type mechanism at the outside of the casing 21. For example, for this purpose, the structure and method shown in FIG. 11 or FIG. 17 may be used, which will be described below.

According to an embodiment, in the variable displacement gerotor pump, the fixed gear 1 and the moving gear 11 may be located in order within the casing 21. In this case, the fixed gear 1 may be rotated in a fixed position as an internal gear. The moving gear 11 meshed and rotated with the fixed gear 1 may be moved in the axial direction to change the meshing width of the fixed gear 1 and the moving gear 11, thereby adjusting the discharge per rotation.

Figure 2:
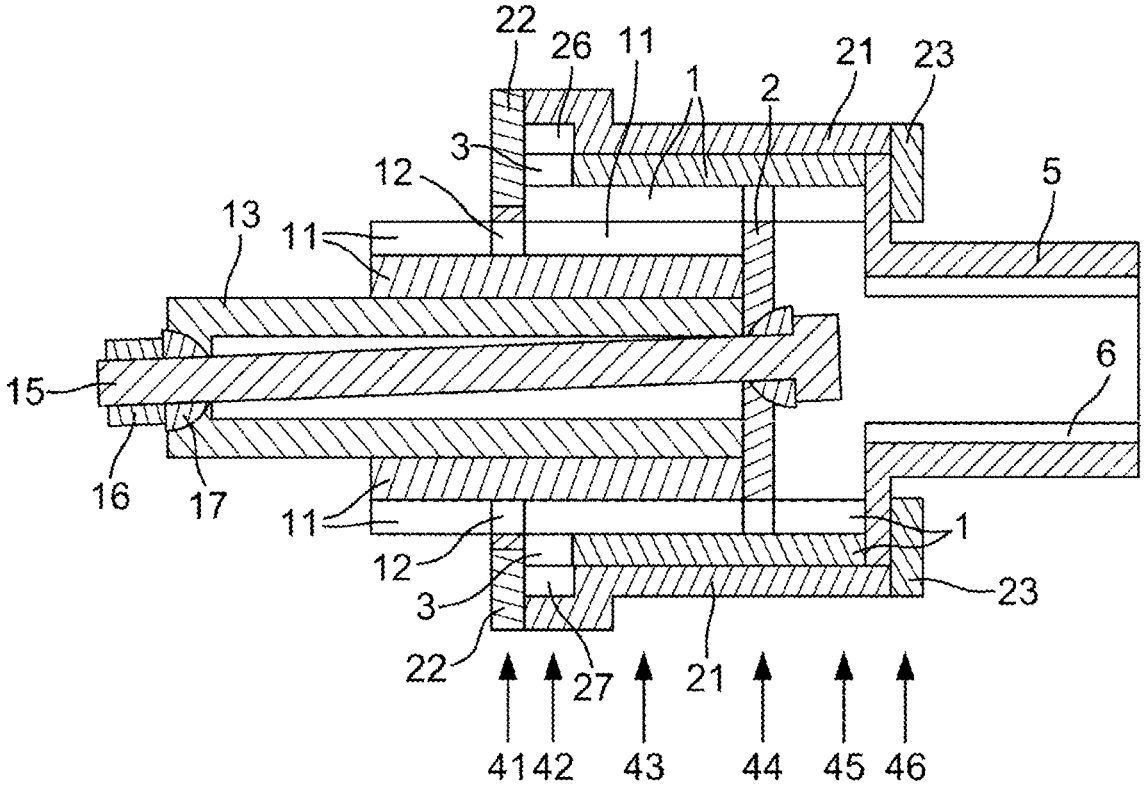
FIG. 2 is a cross-sectional view of the variable displacement gerotor pump of FIG. 1 in an assembled state.

FIG. 2 is a cross-sectional view of the variable displacement gerotor pump of FIG. 1 in an assembled state. FIG. 2 may show a cross-section of the variable displacement gerotor pump cut along from a position indicated by an arrow 47 in FIG. 5 to be described below. As shown, the variable displacement gerotor pump may include the fixed gear 1, the moving gear 11, the casing 21, the gear block 2, the gear ring 12, the gear block bolt 15, the drive flange 5, the gear ring cover 22 and the casing cover 23, and may include a spline gear 6 provided in the drive flange 5.

As shown in FIG. 2, it can be confirmed that there is no gap that could cause fluid leakage between the fixed gear 1, the gear ring 12, and the gear ring cover 22. In addition, it can be confirmed that there is no gaps that could cause fluid leakage between the fixed gear 1, the moving gear 11, and the gear block 2.

In the assembled variable displacement gerotor pump, for the operation as a pump, rotation of the fixed gear 1 and the moving gear 11 may be required. The rotational force may be transmitted from the outside through the drive flange 5 connected to the fixed gear 1. For example, the rotational force may be manually transmitted to the pump by the user or transmitted to the pump by a motor (not shown). Instead of receiving the rotational force from the outside, a high pressure fluid may be supplied through at least one of the fluid inlets 24, 25, and in this case, the pump may operate as a hydraulic motor. Alternatively, the rotational force may be transmitted by a belt, chains, gears, and the like connected to at least one of the moving gear 11, the gear ring 12, the moving gear shaft 13, the fixed gear 1, the gear block 2 or the drive flange 5.

In FIG. 2, it can be seen that the meshing width of the fixed gear 1 and the moving gear 11 is not maximum, and a portion of the moving gear 11 is protruded considerably to the left side of the gear ring cover 22. This shows that the meshing width of the fixed gear 1 and the moving gear 11 is changeable without a fluid leak. When the moving gear 11 is moved in the axial direction, the moving gear shaft 13 and the gear block 2 may be moved together with the moving gear 11 in the axial direction. In this case, a shaft moving means or a control device (not shown) may be connected to the moving gear shaft 13, the gear block 2, the moving gear 11, the gear block bolt 15, the nut 16, or spherical washers 17, 18, and the like and used.

Figure 3:
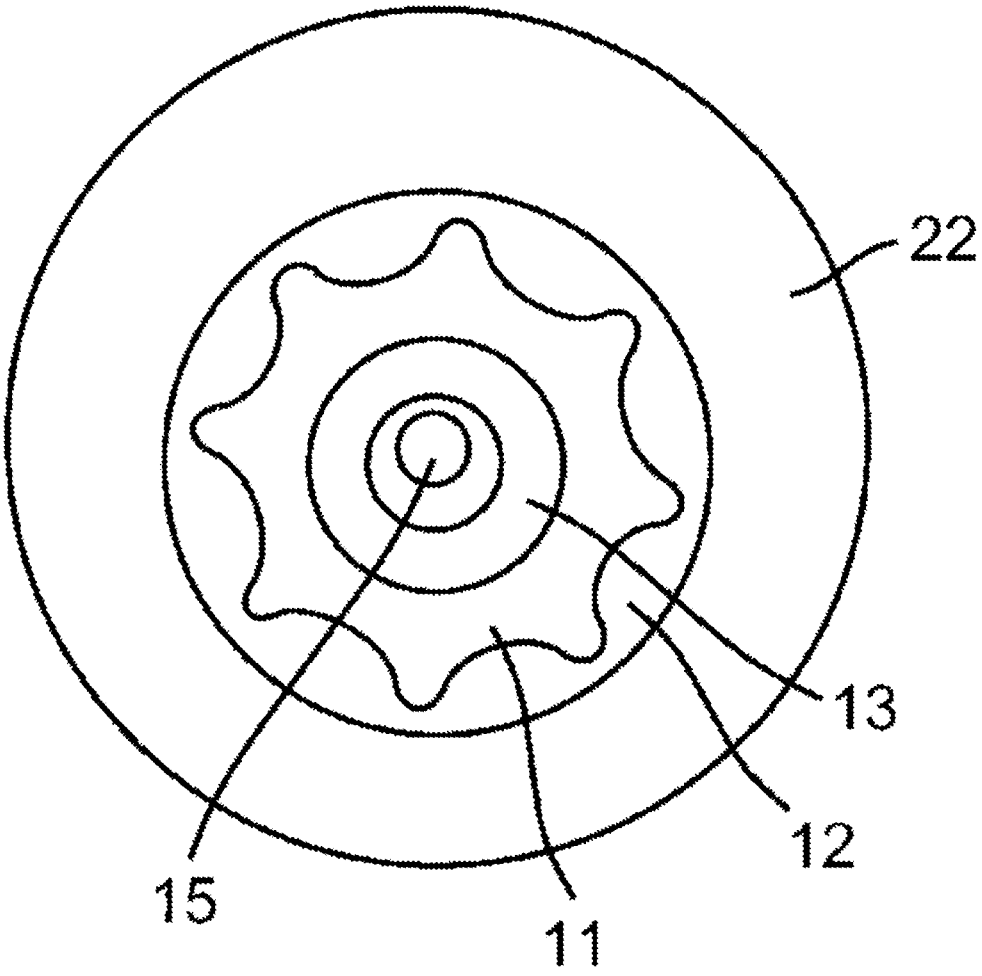
FIG. 3 is a cross-sectional view of the variable displacement gerotor pump of FIG. 2 cut along from outside of the gear ring cover and in a direction orthogonal to the shaft.

FIG. 3 is a cross-sectional view of the variable displacement gerotor pump of FIG. 2 cut along from outside 41 of the gear ring cover and in a direction orthogonal to the shaft. Referring to FIG. 2, FIG. 3 may be a cross section cut along from outside 41 of the gear ring cover of FIG. 2. Inside the hole of the gear ring cover 22, there may be provided the gear ring 12, the moving gear 11, the moving gear shaft 13, and the gear block bolt 15 in order. Accordingly, it is possible to prevent the fluid from flowing between the respective components.

Figure 4:
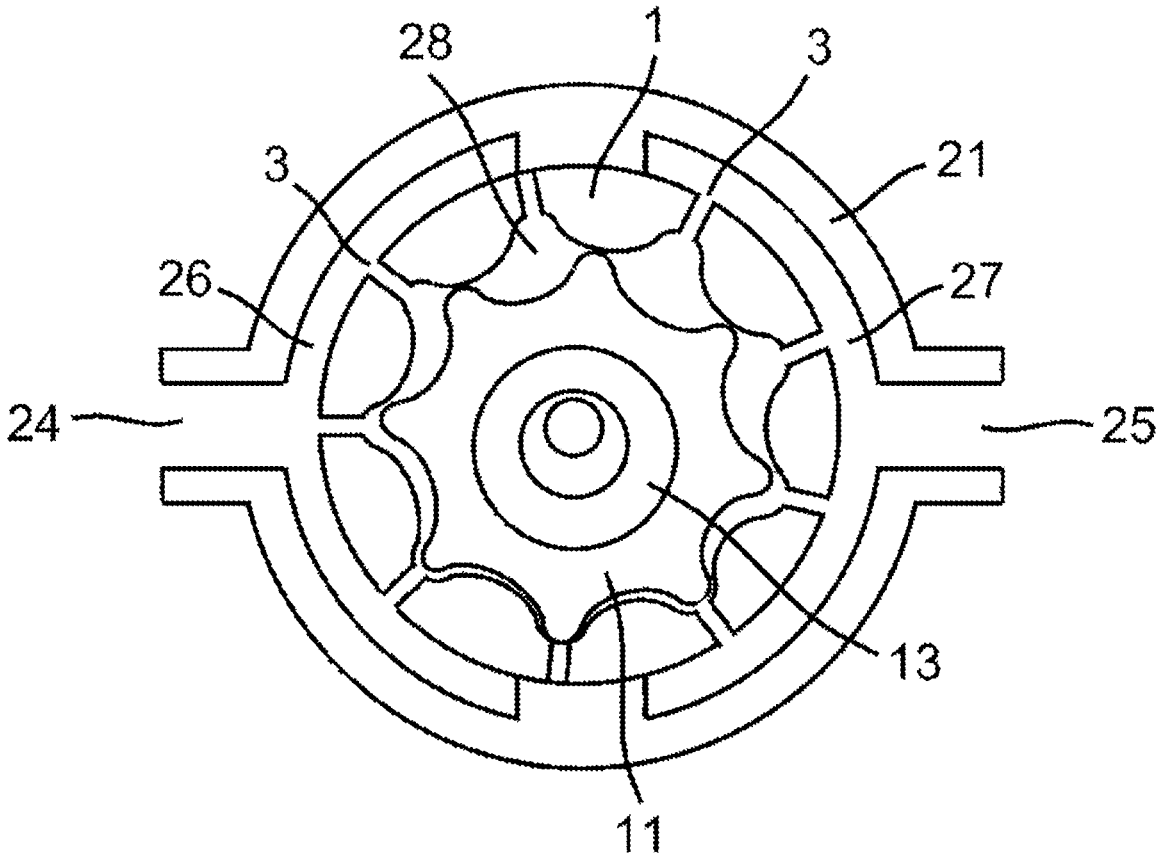
FIG. 4 is a cross-sectional view of the variable displacement gerotor pump of FIG. 2 cut along from outside of one end of a casing where a pumping chamber is located.

FIG. 4 is a cross-sectional view cut along from outside of one end of the casing 21 of the variable displacement gerotor pump of FIG. 2 of the present disclosure where the pumping chambers 26, 27 are located. Referring to FIG. 2, FIG. 4 may be a cross section cut along one end 42 of the casing where the pumping chambers are located.

Inside the casing 21, there may be provided the fixed gear 1 and the moving gear 11 in order. In addition, the teeth of the fixed gear 1 and the teeth of the moving gear 11 may contact each other, forming a plurality of fluid transfer chambers 28. Each of the fluid transfer chambers 28 may be a space surrounded by the fixed gear 1, the moving gear 11, the gear block 2, the gear ring 12, and the gear ring cover 22. The plurality of fluid holes 3 present at one end of the fixed gear 1 may serve as a passage through which the fluid flows between the fluid transfer chambers 28 and the pumping chambers 26, 27. The fluid is not allowed to pass between the fixed gear 1 and the moving gear 11 which are in mesh with each other. That is, when the fixed gear 1 and the moving gear 11 are not rotated, there occurs no fluid movement in the pumping chambers 26, 27 and the plurality of fluid transfer chambers 28.

According to an embodiment, when the fixed gear 1 and the moving gear 11 are rotated clockwise by a rotational force received from the outside, with reference to FIG. 4, the volume of the fluid transfer chambers 28 on the left side may be gradually increased, and the volume of the fluid transfer chambers 28 arranged at the opposite position may be gradually decreased. Therefore, when the fluid transfer chambers 28 is moved from the left pumping chamber 26 to the right pumping chamber 27, the fluid in the left pumping chamber 26 may be contained in the fluid transfer chambers 28 and moved to the right pumping chamber 27. The pump action may be implemented by discharging the fluid to the right fluid inlet 25 when the pressure in the right pumping chamber 27 into which the fluid is introduced is increased. Accordingly, the pressure in the left pumping chamber 26 where the fluid is discharged is decreased so that the fluid can be sucked through the left fluid inlet 24. With a counterclockwise rotation by the rotational force received, the rotation direction of the fixed gear 1 and the moving gear 11 may be reversed. In addition, the movement direction of the fluid transfer chambers 28 and the flow of the fluid may be reversed, in which case the left pumping chamber 26 and the fluid inlet 24 would perform the roles of the right pumping chamber 27 and the fluid inlet 25 described above, respectively. Therefore, depending on the rotation direction of the fixed gear 1 and the moving gear 11, each of the pumping chambers 26, 27 may be a discharge pumping chamber where the fluid is discharged or a suction pumping chamber where the fluid is sucked.

Figure 5:
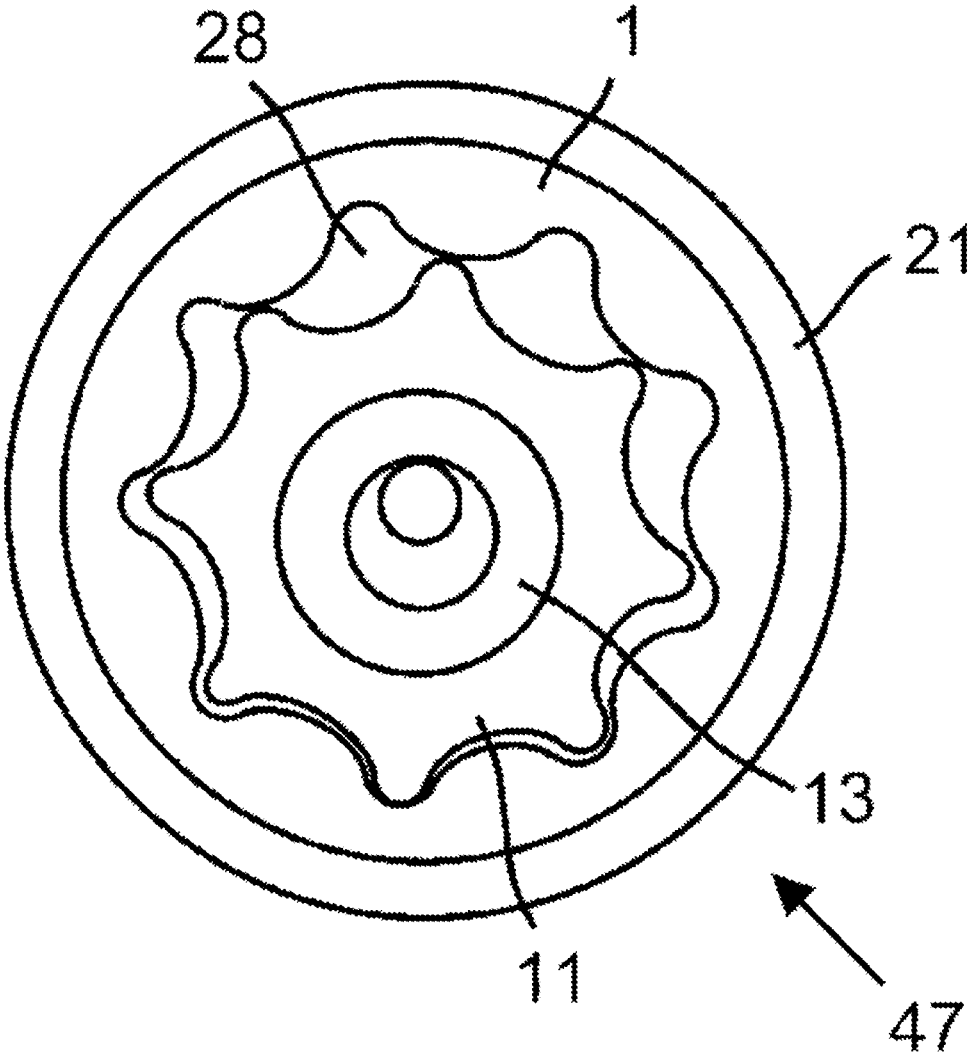
FIG. 5 is a cross-sectional view of the variable displacement gerotor pump of FIG. 2 cut along from outside of the casing.

FIG. 5 is a cross-sectional view of the variable displacement gerotor pump of FIG. 2 cut along from outside of the casing. Referring to FIG. 2, FIG. 5 may be a cross section cut along from an outside 43 position of the casing. Inside the casing 21, there may be provided the fixed gear 1 and the moving gear 11 in order. The teeth of the fixed gear 1 and the teeth of the moving gear 11 may contact each other, forming the plurality of fluid transfer chambers 28. In the cross-sectional view cut along from the outside 43 position of the casing 21, the fluid hole 3 of the fixed gear 1 and the pumping chambers 26, 27 of the casing 21 described above may not be visible.

Figure 6:
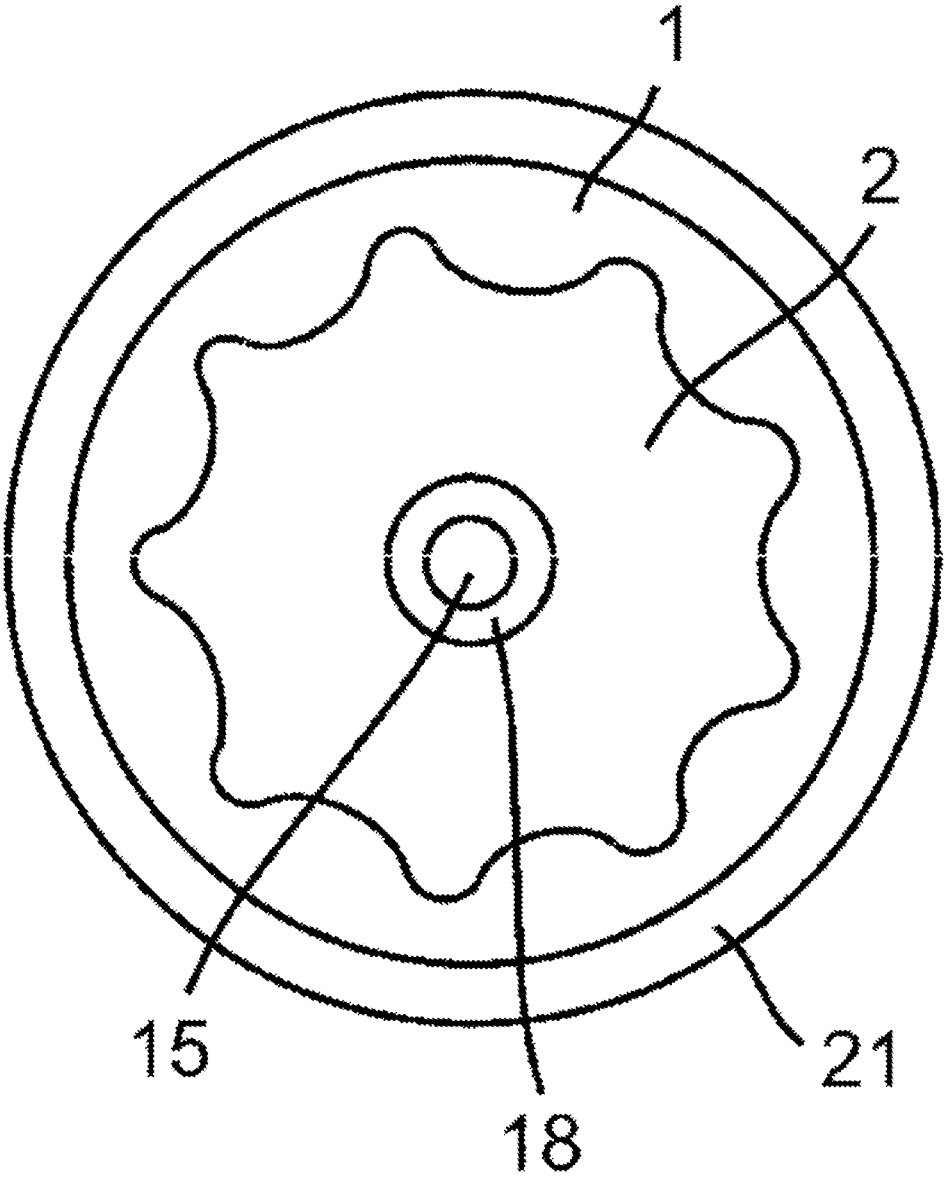
FIG. 6 is a cross-sectional view of the variable displacement gerotor pump of FIG. 2 cut along from outside of the casing where the gear block is located.

FIG. 6 is a cross-sectional view of the variable displacement gerotor pump of FIG. 2 cut along from outside 44 of the casing where the gear block is located. Referring to FIG. 2, FIG. 6 may be a cross section cut along from the outside 44 position of the casing where the gear block is located. Inside the casing 21, there may be provided the fixed gear 1, the gear block 2, the spherical washers 18, and the gear block bolt 15. Accordingly, it is possible to prevent the fluid from flowing between the respective components.

Figure 7:
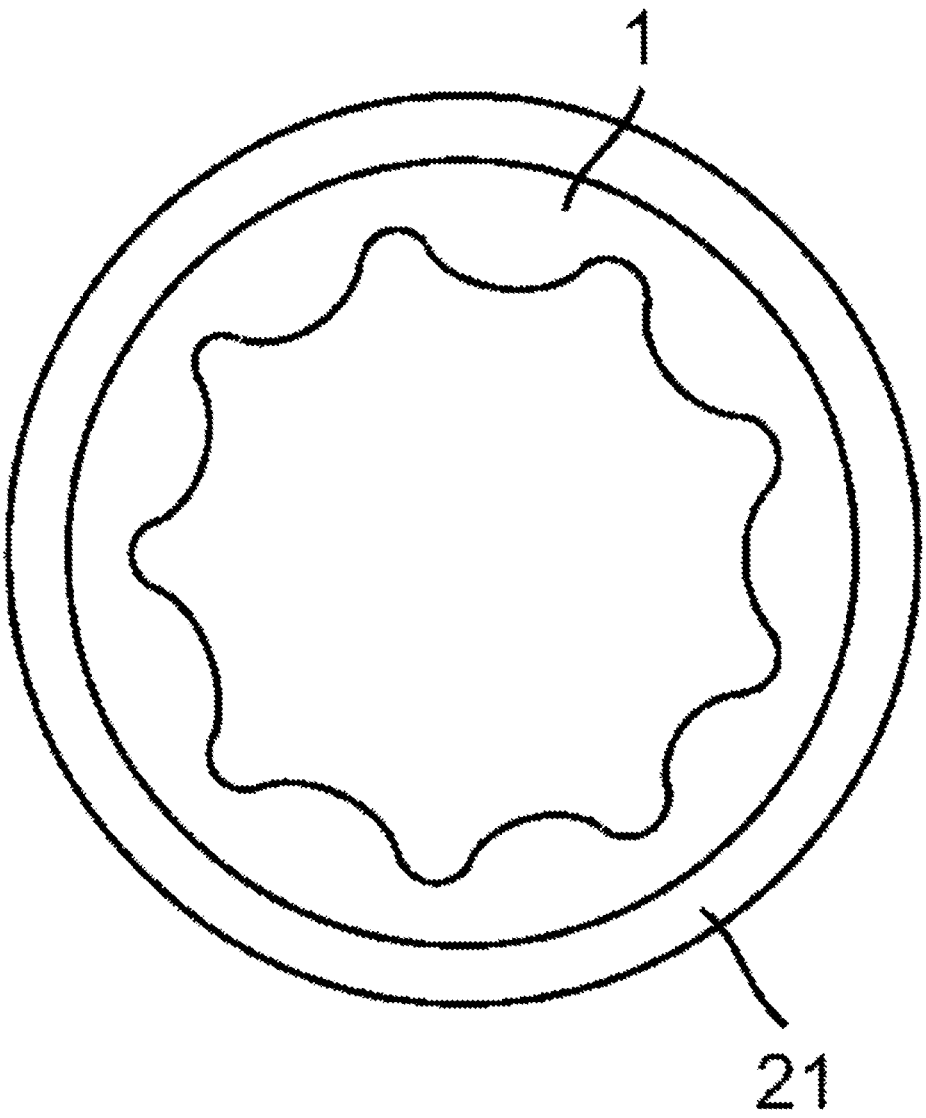
FIG. 7 is a cross-sectional view of the variable displacement gerotor pump of FIG. 2 cut along from outside of the casing, showing a position where there is a hollow space of the fixed gear inside the casing.

FIG. 7 is a cross-sectional view of the variable displacement gerotor pump of FIG. 2 cut along from outside 45 of the casing, showing a position where there is a hollow space of the fixed gear inside the casing. Referring to FIG. 2, FIG. 7 may be a cross section cut along from outside 45 of the casing at a position where the fixed gear is hollow inside the casing. FIG. 7 shows a cross section of the casing 21 and the fixed gear 1 inside the casing.

Figure 8:
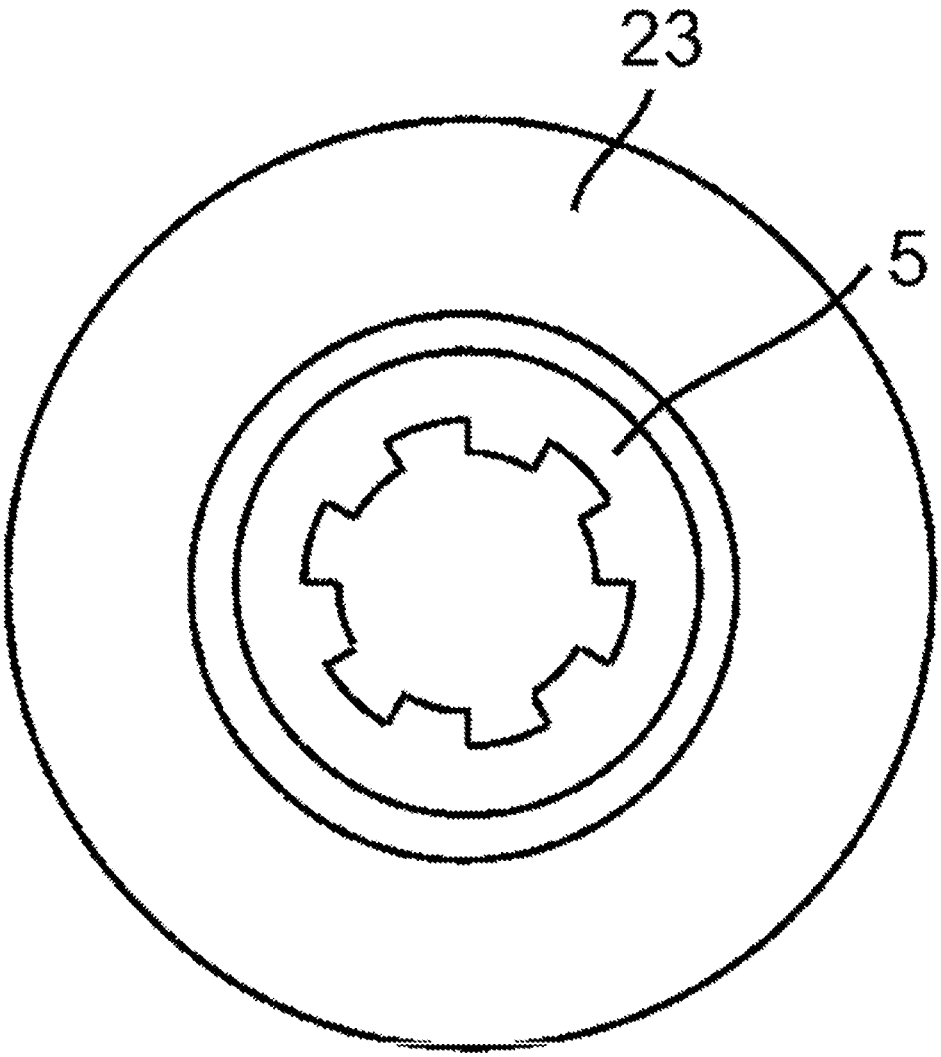
FIG. 8 is a cross-sectional view of the variable displacement gerotor pump of FIG. 2 cut along from outside of a casing cover.

FIG. 8 is a cross-sectional view of the variable displacement gerotor pump of FIG. 2 cut along from outside of a casing cover 46. FIG. 8 shows a cross section of the casing cover 23 and the drive flange 5.

Referring to FIGS. 2 to 8 described above, it can be seen that the inside of the variable displacement gerotor pump includes a structure in which fluid is not discharged. In addition, referring to FIG. 4, as the fixed gear 1 and the moving gear 11 are rotated in the variable displacement gerotor pump, the fluid is moved such that the pump action can be performed. In addition, inside the fixed gear 1, a shaft moving means or a control device (not shown) may be connected to the moving gear shaft 13, the moving gear 11, or the gear block 2 so that the moving gear 11, the moving gear shaft 13, and the gear block 2 may be moved together in the axial direction. Accordingly, the meshing width of the fixed gear 1 and the moving gear 11 may be changed, and the distance between the gear ring 12 and the gear ring cover 22 in the gear block 2 may be changed, and, as the width of the fluid transfer chambers 28 is changed, the volume thereof may be changed. When the volume of the fluid transfer chambers 28 is changed, the pump action is executed, changing an amount of fluid that is moved when the fluid transfer chambers 28 moves the fluid, and thus changing an amount of fluid being sucked and an amount of fluid being discharged.

Figure 9:
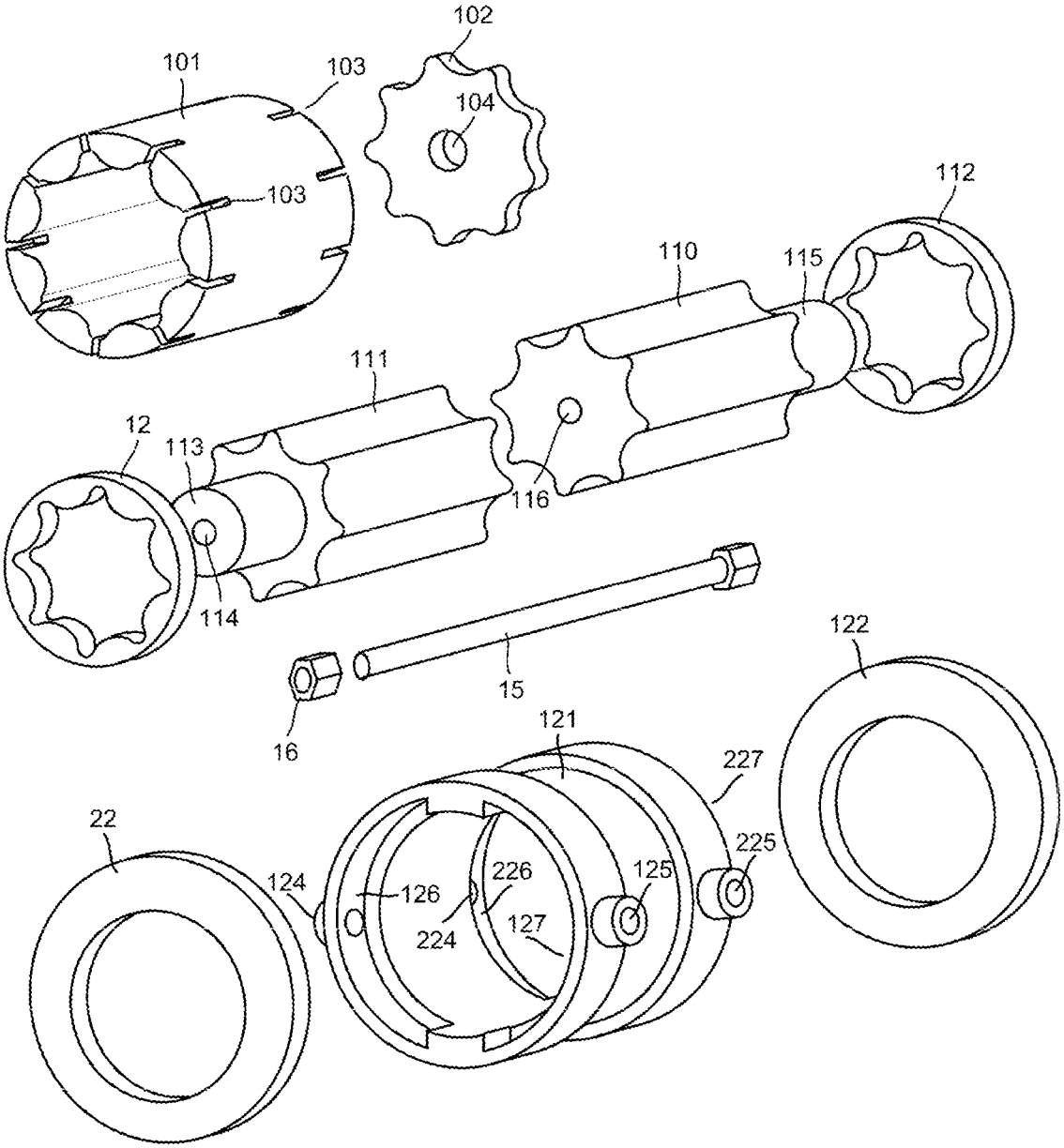
FIG. 9 is an exploded perspective view of a variable displacement gerotor pump according to another embodiment of the present disclosure.

FIG. 9 is an exploded perspective view of a variable displacement gerotor pump according to another embodiment of the present disclosure. As shown, the variable displacement gerotor pump may include a casing 121, a fixed gear 101, a gear block 102, a first moving gear 111, a second moving gear 110, the first gear ring 12, a second gear ring 112, the first gear ring cover 22, a second gear ring cover 122, and the gear block bolt 15.

The variable displacement gerotor pump of FIG. 9 is a modification of the variable displacement gerotor pump of FIG. 1 described above, and may include two moving gears 111, 110, two gear rings 12, 112, and two gear ring covers 22, 122. In this case, fluid inlets 124, 125, 224, 225 may include first fluid inlets 124, 125 at one end of the casing 121 and second fluid inlets 224, 225 at the other end. The fluid inlets 124, 125, 224, 225 may have different amounts of discharge per rotation as necessary, provided that the sum of the amounts of discharge per rotation is constant. Fluid holes 103 may be formed at both ends of the fixed gear 101, and a plurality of pumping chambers 126, 127, 226, 227 in an identical shape may be formed at both ends of the casing 121, respectively. Each of the configurations shown in FIG. 9 may perform the same or similar functions as the corresponding configurations of FIG. 1 described above.

The variable displacement gerotor pump shown in FIG. 9 may include two symmetrical variable displacement gerotor pumps of FIG. 1 described above contacting with each other. Accordingly, the variable displacement gerotor pump of FIG. 9 may have the same or similar functions and effects as the variable displacement gerotor pump of FIG. 1. The rotational force may be transmitted from outside through the first moving gear shaft 113 and the second moving gear shaft 115. The rotational force may also be transmitted from the outside through the fixed gear 101 using a gear, belt, chain, and the like, in a state where a middle portion of the casing 121 is cut out to expose a central portion of the fixed gear 101 to the outside of the casing 121. The method of transmitting the rotational force is not limited to the above, and the rotational force may be transmitted by connecting a belt, a chain, a gear, or a shaft to the first moving gear 111, the second moving gear 110, the first gear ring 12, the second gear ring 112, the first moving gear shaft 113, the second moving gear shaft 115, and the fixed gear 101.

The gear block bolt 15 and the nut 16 may pass through bolt holes 114, 116 located in the moving gear shafts 113, 115 and a gear block hole 104 in the gear block 102. As a result, fluid may not leak from the contact surfaces of the first moving gear 111, the second moving gear 110, and the gear block 102. In addition, the distance between and the pressure of the components are adjusted, so that the first moving gear 111, the second moving gear 110, and the gear block 102 may be moved in the axial direction at the same time. In this case, the gear block 102, which is in contact with the inner surface of the fixed gear 101, may have different rotational speeds from the first moving gear 111 and the second moving gear 110. In addition, when the centers of the gear block 102, the first moving gear 111, and the second moving gear 110 do not coincide, it may cause a movement of the gear block 102 relative to the first moving gear 111 and the second moving gear 110. Meanwhile, the method of allowing the first moving gear 111, the second moving gear 110, and the gear block 102 to move in the axial direction together while maintaining contact without a fluid leak from each of the contact surfaces is not limited thereto. For example, the first moving gear 111 and the second moving gear 110 may be brought into close contact each other through a clamp-type device outside of the casing 121. For example, the structure or method shown in FIG. 13 may be applied, which will be described below. Since the first moving gear 111 and the second moving gear 110 are always rotated together, rather than being inclined obliquely from horizontal as shown in FIG. 1, the gear block bolt 15 may be maintained in parallel with the axial direction. In this case, the gear block hole 104 of the gear block 102 may be greater than or equal to the gear block hole 4 of the gear block 2 shown in FIG. 1.

Figure 10:
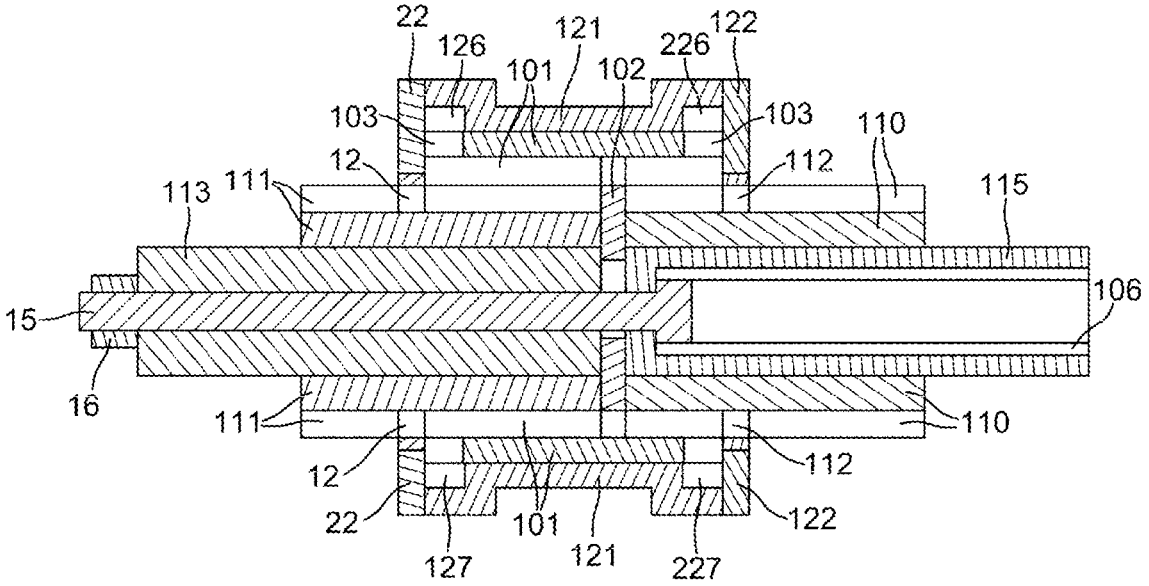
FIG. 10 is a cross-sectional view of the variable displacement gerotor pump of FIG. 9 in an assembled state.

FIG. 10 is a cross-sectional view of the variable displacement gerotor pump of FIG. 9 in an assembled state. When the first moving gear 111 and the second moving gear 110 are moved in the axial direction, the first moving gear shaft 113, the second moving gear shaft 115, and the gear block 102 may be moved together in the axial direction. A shaft moving means or a control device (not shown) for enabling such movement may be connected to the first moving gear shaft 113, the second moving gear shaft 115, or the first moving gear 111, and the second moving gear 110 and used. In addition, a spline gear 106 may be included inside the second moving gear shaft 115.

The shaft moving means or the control device (not shown) may be connected to the moving gear shafts 113, 115 or the moving gears 111, 110, and move the moving gears 111, 110, the moving gear shafts 113, 115, and the gear block 102 together in the axial direction within the fixed gear 101. Then, with reference to the gear block 102, the meshing width of the fixed gear 101 and the first moving gear 111 on the left side, and the meshing width of the fixed gear 101 and the second moving gear 110 on the right side may be changed. In addition, the width of both fluid transfer chambers (not shown) may be changed, the volume of both fluid transfer chambers may be changed, and thus, the discharge per rotation discharged from the fluid inlets (not shown) at both ends of the casing 121 may be changed.

Meanwhile, with reference to the gear block 102, the sum of the meshing width of the fixed gear 101 and the first moving gear 111 on the left side, and the meshing width of the fixed gear 101 and the second moving gear 110 on the right side can be constant. As a result, the sum of the amounts of discharge per rotation can be constant. Accordingly, the variable displacement gerotor pump may have different amounts of discharge per rotation as needed.

Figure 11:
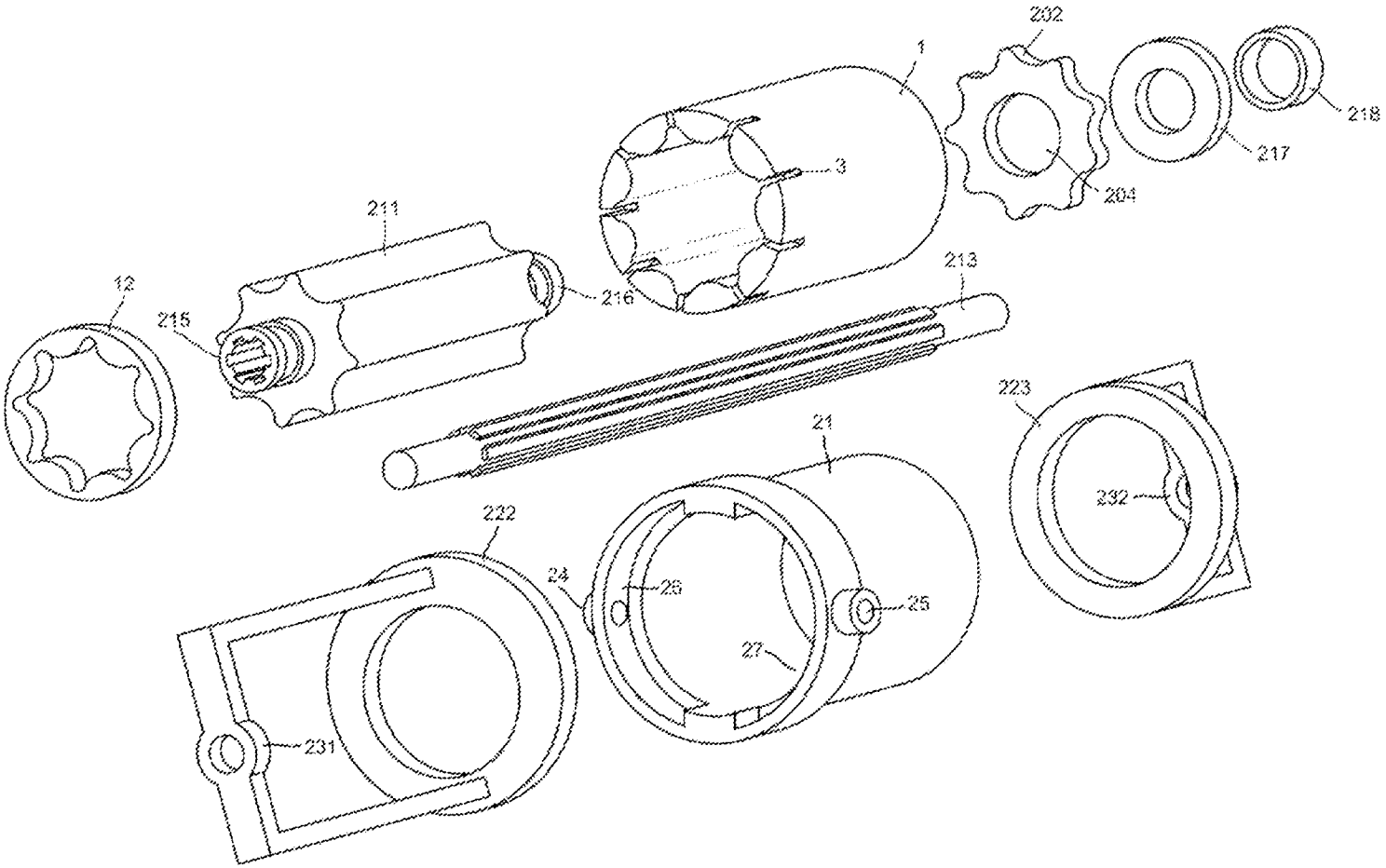
FIG. 11 is an exploded perspective view of a variable displacement gerotor pump according to still another embodiment of the present disclosure.

FIG. 11 is an exploded perspective view of a variable displacement gerotor pump according to still another embodiment of the present disclosure. Referring to FIG. 1, the variable displacement gerotor pump of FIG. 11 may be formed by removing the drive flange 5 from the variable displacement gerotor pump of FIG. 1 and installing a moving gear 211 on a moving gear shaft 213. As shown, the variable displacement gerotor pump may include a gear block 202, a gear block hole 204, moving gear sleeves 215, 216, a gear block support plate 217, a nut 218, and a gear ring cover 222, a casing cover 223, and moving gear shaft support devices 231, 232.

The variable displacement gerotor pump can prevent the generation of torsion between the fixed gear 1 and the moving gear 211 even when the pressure inside the pumping chambers 26, 27 is high. As such, the variable displacement gerotor pump of FIG. 11 may be a modified example in which a driving-related part of the variable displacement gerotor pump of FIG. 1 is modified. For example, the rotating shaft 213 driving the moving gear 211 may have a structure such that it penetrates the moving gear 211. Instead of the drive flange 5 of FIG. 1 described above, the moving gear 211 may be driven through the moving gear shaft 213, but embodiment is not limited thereto, and the structure or method shown in FIG. 17 may be used, which will be described below.

The gear block 202 may be installed on the moving gear sleeve 216 provided at one end of the moving gear 211 using the gear block support plate 217 and the nut 218. The fluid leak between the moving gear 211 and the gear block 202 and the fluid leak between the fixed gear 1 and the gear block 202 can be prevented. The gear block 202 is relatively rotatable with respect to the moving gear 211, and the moving gear 211 and the gear block 202 may be moved together within the fixed gear 1 in the axial direction. Since the diameter of the gear block hole 204 may be greater than the diameter of the moving gear sleeve 216, and the centers of the gear block 202 and the moving gear 211 do not coincide with each other, the gear block 202 may be moved slightly in all directions. The moving gear 211 or the moving gear sleeves 215, 216 may have a spline gear (not shown) formed therein, and thus installed in mesh with the moving gear shaft 213 on which the spline gear is formed, so that it may be moved together with the moving gear shaft 213 and moved in the axial direction. The moving gear shaft 213 may be supported by the moving gear shaft support devices 231, 232. Meanwhile, it is not intended to limit that the spline gear is provided in the moving gear 211 or the moving gear sleeves 215, 216 and on the moving gear shaft 213. For example, there may be a pillar or inner surface with polygonal or star-shaped corners in the moving gear 211 or the moving gear sleeves 215, 216 and on the moving gear shaft 213.

Figure 12:
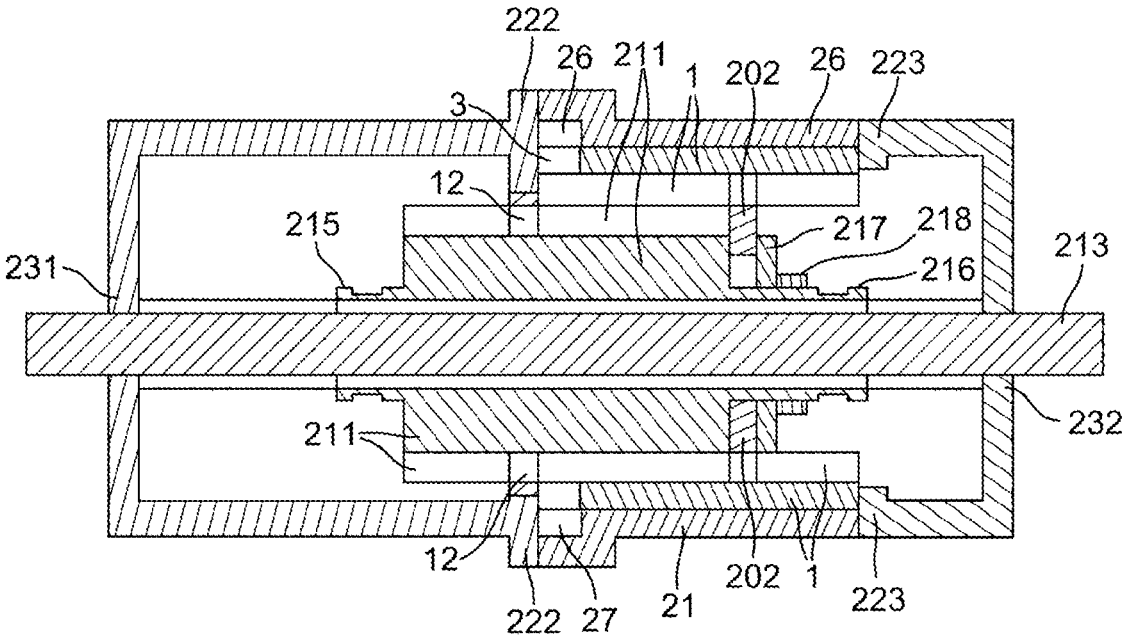
FIG. 12 is a cross-sectional view of the variable displacement gerotor pump of FIG. 11 in an assembled state.

FIG. 12 is a cross-sectional view of the variable displacement gerotor pump of FIG. 11 in an assembled state. The moving gear 211 in mesh with the fixed gear 1 may be moved in the axial direction, and a fluid leak may be prevented by the gear ring 12 and the gear block 202. The rotational force for rotating the fixed gear 1 and the moving gear 211 may be transmitted through the moving gear shaft 213, but is not limited thereto. For example, a gear may be formed on an outer circumference of the fixed gear 1, and a hole may be formed in the middle of the casing 21 to allow an external gear to be meshed with the gear formed on the outer circumference of the fixed gear 1. A means for adjusting the discharge per rotation or a control device (not shown) may contact the moving gear sleeves 215, 216 to move the moving gear 211 in the axial direction. The variable displacement gerotor pump shown in FIGS. 11 to 12 may perform the same or similar pump operation as the variable displacement gerotor pump of FIG. 1, and can variably adjust the discharge per rotation according to the same or similar principle.

Figure 13:
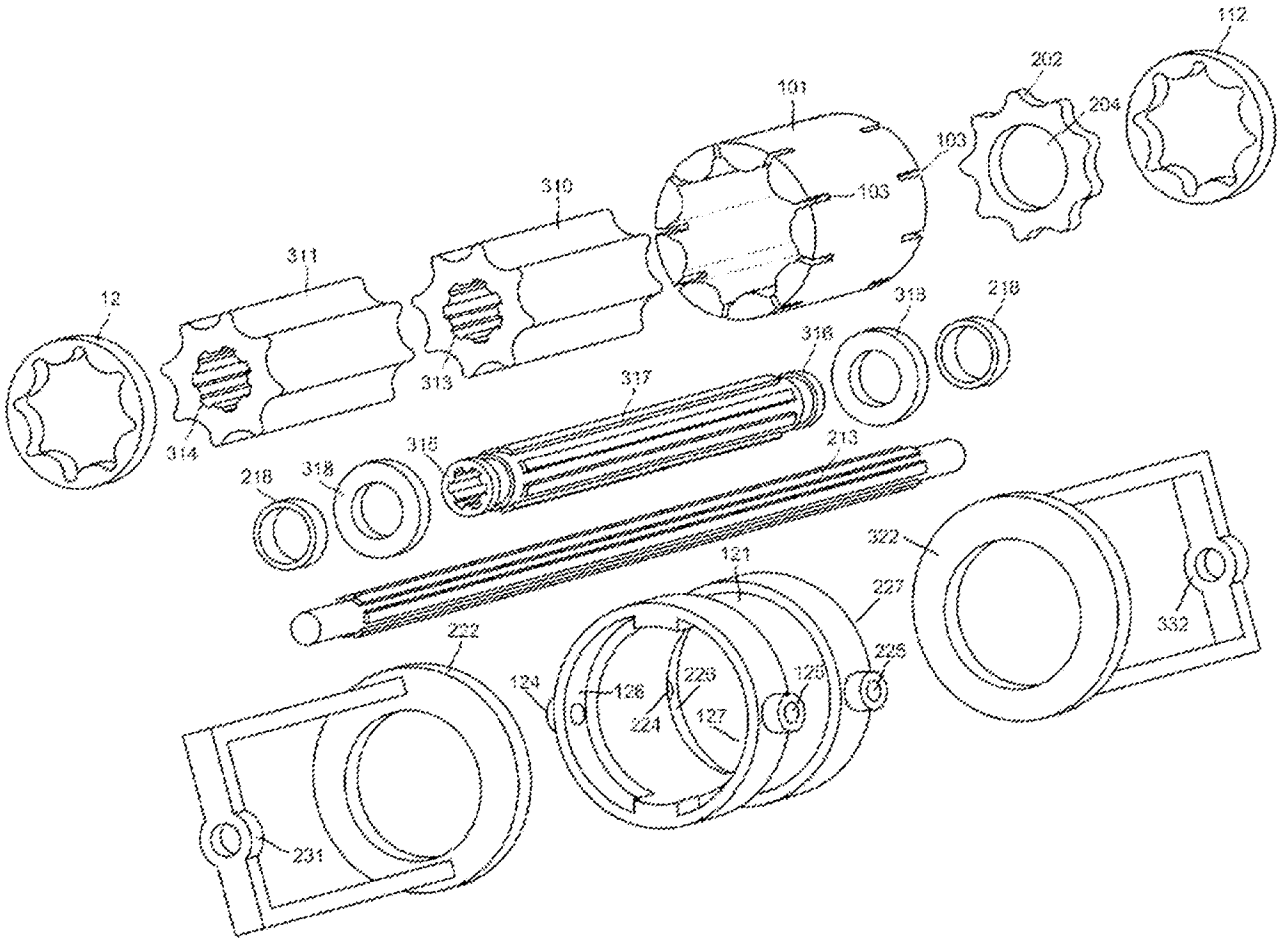
FIG. 13 is an exploded perspective view of a variable displacement gerotor pump according to still another embodiment of the present disclosure.

FIG. 13 is an exploded perspective view of a variable displacement gerotor pump according to still another embodiment of the present disclosure. Compared with the pump of FIG. 9, the pump of FIG. 13 may have a change in the configuration related to driving of the moving gears 111, 110. For example, the moving gears 111, 110, the moving gear shafts 113, 115, the gear block bolt 15 and the nut 16 of the variable displacement gerotor pump of FIG. 9 may be changed in shape or configuration to moving gears 311, 310, a moving gear common shaft 317, the moving gear shaft 213, a moving gear support plate 318, and the nut 218 of the variable displacement gerotor pump shown in FIG. 13. In this case, the moving gear common shaft 317 may include moving gear common shaft sleeves 315, 316. Accordingly, various methods described with reference to FIG. 9 may be applied in relation to the driving of the pump of FIG. 13. In addition, as shown, the variable displacement gerotor pump may include the second moving gear 310, the first moving gear 311, the moving gear common shaft sleeves 315, 316, the first gear ring cover 222, a second gear ring cover 322, the first moving gear shaft support device 231, and a second moving gear shaft support device 332.

Meanwhile, the moving gear common shaft 317 is not limited to the configuration shown in FIG. 13, and various methods are applicable, such as using the separated moving gear shaft 213, and the like.

As an example, referring to FIG. 11, the variable displacement gerotor pump includes a spline gear therein, and uses the moving gear 211 having the moving gear sleeves 215, 216 formed at both ends. This method can be used in the variable displacement gerotor pump of FIG. 13. In this case, by removing at least one of the moving gear sleeves 215, 216 from the moving gear 211 of the variable displacement gerotor pump of FIG. 11, a plurality of corresponding moving gears may be used.

There may be no meaningful change in the fixed gear 101, the gear block 202, the gear ring 12, the second gear ring 112, the casing 121, the gear ring cover 222, and the second gear ring cover 322 forming the first pumping chambers 126, 127, the second pumping chambers 226, 227, and the plurality of fluid transfer chambers (not shown). Moving gear holes 314, 313 may be included in the centers of the first and second moving gears 311, 310. While the spline gears are formed inside the moving gear holes 314, 313, the first pumping chambers 126, 127, the second pumping chambers 226 and 227, and the plurality of fluid transfer chambers 28 may not be changed. With these changes, the moving gears 311, 310 may be rotated through the moving gear shaft 213 and the moving gears 311, 310 may be moved in the axial direction through the moving gear common shaft 317.

The spline gears shown in FIG. 13, which may be formed inside or outside the moving gear holes 314, 313 of the moving gears 311, 310 and inside or outside the moving gear common shaft 317, and on the moving gear shaft 213, may be replaced by other means. For example, the structure may be configured in various shapes such as polygonal or star-shaped pillars. In addition, embodiment is not limited to using the nuts 218 at both ends of the moving gear common shaft 317, and accordingly, there may be one provided in the form of a bolt head at one end, and the nut 218 may be used at the other end.

Figure 14:
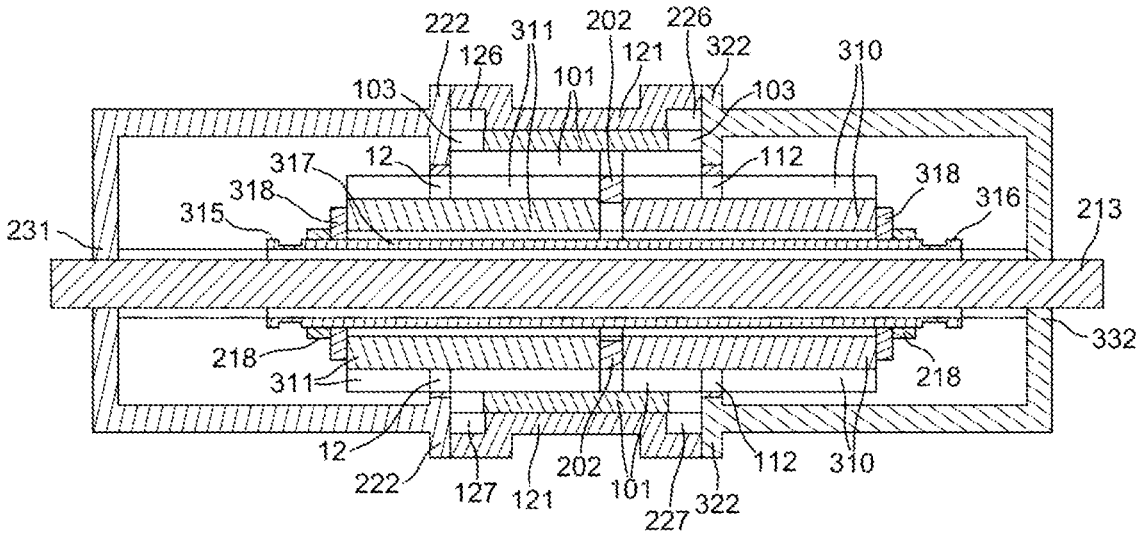
FIG. 14 is a cross-sectional view of the variable displacement gerotor pump of FIG. 13 in an assembled state.

FIG. 14 is a cross-sectional view of the variable displacement gerotor pump of FIG. 13 in an assembled state. As shown, the moving gears 311, 310 are provided with the moving gear common shaft 317 penetrating therethrough so that the moving gears 311, 310 may be moved together with the moving gear common shaft 317 in the axial direction. In this case, the shaft moving means or the control device (not shown) may be connected to the moving gear common shaft sleeves 315, 316 to allow it to be moved in the axial direction.

When the moving gears 311, 310 and the gear block 202 are moved in the axial direction together by the shaft moving means or control device connected to the moving gear common shaft sleeves 315, 316, with reference to the gear block 202, the meshing width of the left side of the fixed gear 101 and the first moving gear 311 and the right side of the fixed gear 101 and the second moving gear 310 may be changed. In this case, the sum of the meshing widths and the sum of the amounts of discharge per rotation may be constant. In addition, the width and volume of the plurality of fluid transfer chambers (not shown) may be changed. Accordingly, the discharge per rotation from the fluid inlet (not shown) of the casing may be changed.

According to the embodiments described above, in the related gerotor pump, when the rotation speed of the input rotation shaft is fixed, the discharge per unit time may be fixed, and when the torque of the input rotation shaft is fixed, the maximum discharge hydraulic pressure of the fluid may be fixed. In addition, in the variable displacement gerotor pump, when the rotation speed of the input rotation shaft is fixed, the discharge per unit time can be adjusted, and when the torque of the input rotation shaft is fixed, the maximum discharge hydraulic pressure of the fluid can be adjusted.

In the variable displacement gerotor pump according to the embodiments of the present disclosure, when the speed of the input rotation shaft is fixed, the discharge per unit time may be adjusted. In addition, when the discharge per unit time is adjusted, the hydraulic pressure of the pumping chamber for discharging the fluid may also be adjusted. Even when the variable displacement gerotor pump is connected to the shaft of the frequently changing rotational speed, such as an engine of an automobile, the discharge per unit time can be adjusted to a certain level by adjusting the discharge per rotation. Accordingly, the hydraulic pressure of the discharge pumping chamber can also be adjusted to a certain level.

In the variable displacement gerotor pump, it may be problematic when the discharge per unit time is too small or the pressure in the discharge pumping chamber is too low, and it may also be problematic when the discharge per unit time is too large or the pressure in the discharge pumping chamber is too high. In addition, in the variable displacement gerotor pump, various problems may occur, such as inadequate fluid supply to where it is needed, straining of the machine, waste of energy, and the like.

Figure 15:
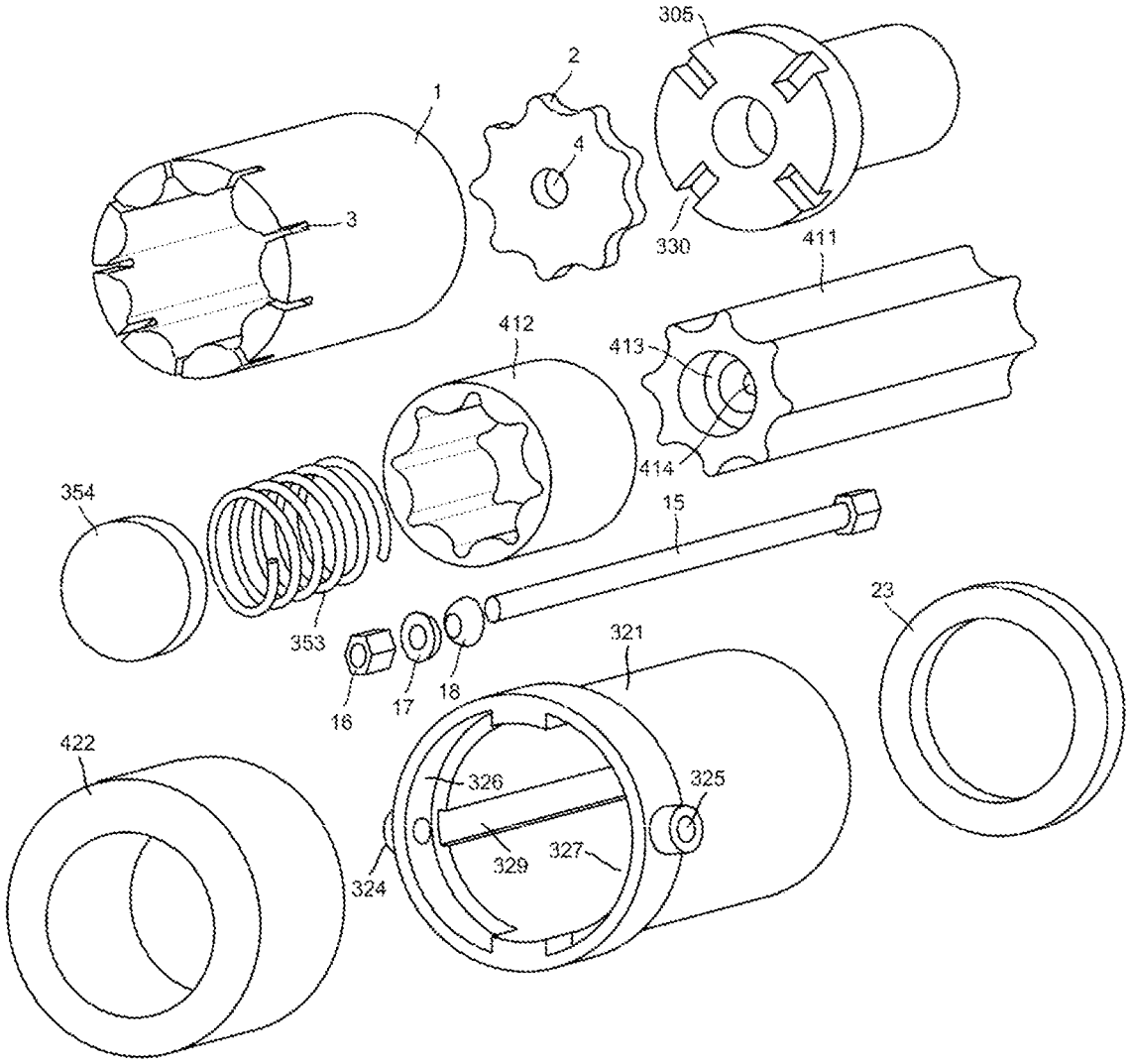
FIG. 15 is an exploded perspective view of a variable displacement gerotor pump according to still another embodiment of the present disclosure.

FIG. 15 is an exploded perspective view of a variable displacement gerotor pump according to still another embodiment of the present disclosure. The shown variable displacement gerotor pump may maintain the hydraulic pressure of a pumping chamber 326 for discharging fluid and the discharge per unit time within a certain range regardless of the rotational speed of the driven shaft. In addition, the variable displacement gerotor pump may include fluid inlets 324, 325, pumping chambers 326, 327, a spring 353, a spring support 354, a moving gear 411, a gear ring 412, a moving gear shaft 413, a bolt hole 414, and a gear ring cover 422.

Figure 16:
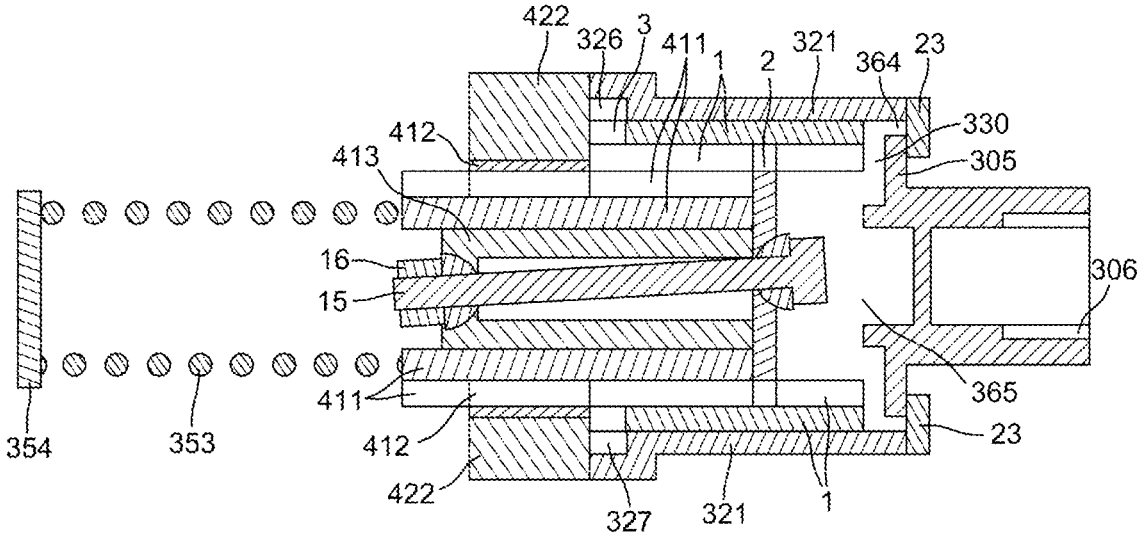
FIG. 16 is a cross-sectional view of the variable displacement gerotor pump of FIG. 15 in an assembled state.
Figure 17:
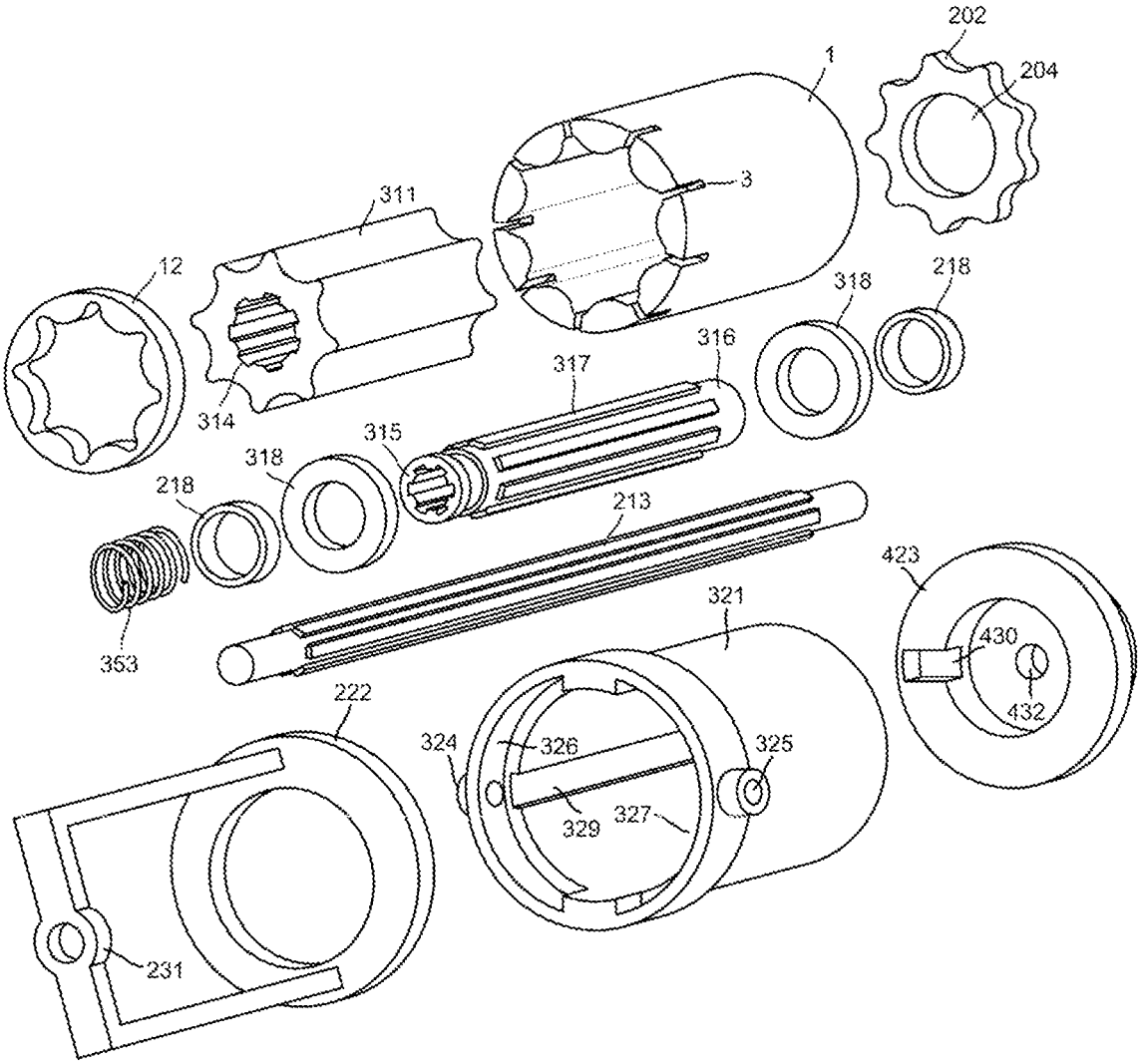
FIG. 17 is an exploded perspective view of a variable displacement gerotor pump according to still another embodiment of the present disclosure.

Referring to FIG. 1, having a spline shaft penetrating therethrough, the drive flange 5 does not confine fluid therein, whereas a drive flange 305 shown in FIG. 15 is blocked so that it can confine the fluid therein. The diameter of a portion of the drive flange 305 contacting the fixed gear 1 may be slightly smaller than the diameter of the fixed gear 1, which may ensure a space necessary for forming a fluid conduit 364 through which fluid can flow around the drive flange 305 in contact with the fixed gear 1. A fluid connection passage 330 in the drive flange 305 may be configured to allow fluid to flow in and out of the fixed gear 1. The configuration of the fluid conduit 364 can be easily observed in FIG. 16 to be described below. Referring to FIGS. 16 and 17, the drive flange 305 is not necessarily provided, and when the drive flange 305 is not used, one end of a casing 321 may be blocked using a casing cover 423 of FIG. 17 to be described below. In order to install a hydraulic chamber 365, a method of confining the fluid on the right side with reference to the gear block 2 in the fixed gear 1 may be used. Meanwhile, the method for installing the hydraulic chamber 365 is not limited to the above. For example, as shown in FIG. 16, a method for installing the hydraulic chamber 365 may be used, in which case the fluid may be confined in a space surrounded by the fixed gear 1 and the gear block 2, on the right side of the gear block 2 where there is no moving gear 411 present.

Referring to FIGS. 1 and 15, while there are pumping chambers 26, 27 separated from each other formed at one end of the casing 21, there may be the pumping chambers 326, 327 separated from each other formed at one end of the casing 321, and a fluid connection passage 329 may be formed between one pumping chamber 326 and the other end of the casing 321. In the fluid connection passage 329, a passage from the pumping chamber 326 to the fluid conduit 364 serves as a passage through which fluid can flow. In this case, the connected pumping chamber 326 may be a discharge pumping chamber for discharging the fluid, and the fluid inlet 324 may be an outlet for discharging the fluid. To do so, the fixed gear 1 and the moving gear 11 may be rotated counterclockwise. The method of allowing the fluid to pass between the pumping chamber 326 for discharging and the fluid conduit 364 or the hydraulic chamber 365 is not limited to the fluid connection passage 329. For example, a hose may be attached to the outside for connection. When the fluid exiting from the pump by pumping is recovered to the pump, the fluid conduit 364 may be connected to the end of the recovering hose and used. Due to the difference between the respective driving flanges 5 and 305, the space on the right side of the gear block 2 inside the fixed gear 1 shown in FIG. 1 is open. However, the space on the right side of the gear block 2 inside the fixed gear 1 of FIG. 15 is closed. The space on the right side may be surrounded by the fixed gear 1, the gear block 2, and the drive flange 305. In addition, since the passage through the fluid conduit 364 is the fluid connection passage 330, one hydraulic chamber 365 may be formed. The hydraulic pressure of the pumping chamber 326, the fluid connection passages 329, 330, the fluid conduit 364, and the hydraulic chamber 365 for discharging the fluid is always maintained the same.

In the hydraulic chamber 365, the fixed gear 1 may serve as a cylinder, and the gear block 202 may serve as a piston. The gear block 202 may be moved in the axial direction according to the internal hydraulic pressure. When pumping is started by the rotation of the fixed gear 1 and the moving gear 11, the gear block 202 may be positioned at a point at which the restoring force of the spring 353, the force acting in the hydraulic chamber 365, and the force acting in the fluid transfer chambers 28 are balanced. The shape, place of installation, method of installation, method of adjusting the restoring force, and the like of the shown spring 353 are not limited to the above. For example, a variety of methods can be used, such as, manually adjusting the restoring force, controlling using an actuator, and so on.

FIG. 16 is a cross-sectional view of the variable displacement gerotor pump of FIG. 15 in an assembled state. As shown, the variable displacement gerotor pump may include the fluid conduit 364 formed around the fixed gear 1 and the drive flange 305 contacting the fixed gear 1, and the hydraulic chamber 365 formed on the right side with reference to the gear block 2 inside the fixed gear 1.

In the gear block 2, a portion of the gear block 2 may be gradually exposed to a plurality of fluid transfer chambers (not shown) on the left side with reference to the gear block 2. Since the right side with reference to the gear block 2 is completely exposed to the hydraulic chamber 365, the area in which the hydraulic pressure is applied may be wider than the left side with reference to the gear block 2. As a result, a greater force may be exerted on the right side than the left side with reference to the gear block 2. Specifically, referring to FIG. 5, regarding the cross sections of the fluid transfer chambers 28, since the fluid transfer chambers 28 on the side of the pumping chamber for discharging is half of the entire fluid transfer chambers 28, the area in which the hydraulic pressure of the discharged fluid is applied may be half of the cross section of the entire fluid transfer chambers 28. On the other hand, referring to FIG. 7, the cross section near the hydraulic chamber may be the entire area of the gear block 2. Accordingly, the strength of the force applied on both sides with reference to the gear block 2 may increase in proportion to the strength of the hydraulic pressure of the discharged fluid and the size of the area in which the hydraulic pressure is applied. In addition, the difference in the force applied on both sides of the gear block 2 may increase as the hydraulic pressure of the discharged fluid increases, and as the hydraulic pressure of the discharged fluid increases, the gear block 2 may be pushed more strongly toward the gear ring 412 and the gear ring cover 422.

Accordingly, as the hydraulic pressure increases, the gear block 2 may have a stronger tendency to move to the left side with reference to the gear block 2. As a result, the gear block 2 can be moved to the left side until the sum of the hydraulic pressure of the fluid transfer chamber applied on the gear block 2 and the restoring force of the spring 353 balances with the force of the hydraulic pressure of the hydraulic chamber 365 applied on the gear block 102. As the gear block 2 is moved to the left, the discharge per rotation may be gradually reduced. When the gear block 2 is moved all the way to the left, discharge may stop, and the hydraulic pressure of the discharge pumping chamber 326 may not increase. The hydraulic pressure of the discharge pumping chamber 326 is also associated with the discharge of the fluid. When the fluid is efficiently discharged even at a low hydraulic pressure, the hydraulic pressure of the discharge pumping chamber 326 may be kept low. When the fluid is not efficiently discharged even at a high hydraulic pressure, the hydraulic pressure of the discharge pumping chamber 326 may increase to the maximum hydraulic pressure possible. As the gear block 2 is moved to the left, the discharge per rotation may gradually decrease and the maximum discharge hydraulic pressure may increase, but when the discharge per rotation gradually decreases in a situation where the fluid is being discharged, there is a limit to the increase of the discharge hydraulic pressure. When the discharge of the fluid stops, as the fluid in the discharge pumping chamber 326 flows into the hydraulic chamber 365 through the fluid connection passages 329, 330, thus increasing the hydraulic pressure, the gear block 2 can moved further to the left, resulting in a decrease in the discharge per rotation. As a result, since the discharge stops, the hydraulic pressure of the discharge pumping chamber 326 may not increase.

Therefore, when the position of the spring support 354 is adjusted to adjust the restoring force of the spring 353, the rotational speed of the drive flange 305 increases so that the discharge per unit time increases, and when the discharge hydraulic pressure increases, the pressure in the pressure chamber 365 also increases, so that the gear block 2 may be moved to the left to find a new balance point. The discharge per unit time is reduced again, and the hydraulic pressure of the discharge pumping chamber 326 may decrease. When the rotational speed of the drive flange 305 decreases, the discharge per unit time is reduced, and when the hydraulic pressure of the discharge pumping chamber 326 decreases, the pressure in the pressure chamber 365 may also decreases. Then, as the gear block 2 is moved to the right and a new balance point is found, the discharge per unit time may be increased again, and the hydraulic pressure of the discharge pumping chamber 326 may also increase. As a result, the discharge per unit time and the hydraulic pressure of the discharge pumping chamber 326 may respond and adjusted according to the position of the spring support 354. The increasing discharge per unit time and the increasing hydraulic pressure in the discharge pumping chamber 326 do not refer to the characteristics of the variable displacement pump, but may explain a situation in which the hydraulic pressure increases as the supply amount increases when the discharged fluid is discharged and supplied to the customer rather than being confined.

As described above, the variable displacement gerotor pump shown in FIGS. 15 and 16 can maintain the hydraulic pressure of the discharge pumping chamber and the discharge per unit time within a certain range by adjusting the restoring force of the spring 353.

FIG. 17 is an exploded perspective view of a variable displacement gerotor pump according to still another embodiment of the present disclosure. The shown variable displacement gerotor pump may maintain the hydraulic pressure of the pumping chamber 326 and the discharge per unit time within a certain range regardless of the rotational speed of the driven shaft. As shown, the variable displacement gerotor pump may include the fixed gear 1, the moving gear 311, the gear ring 12, the gear block 202, the moving gear support plate 318, the nut 218, the gear ring cover 222, and a moving gear shaft support device 432. In addition, the variable displacement gerotor pump may include the casing 321 and the casing cover 423, and the casing 321 and the casing cover 423 may be those modified from the configurations shown in FIGS. 11 and 12.

Figure 18:
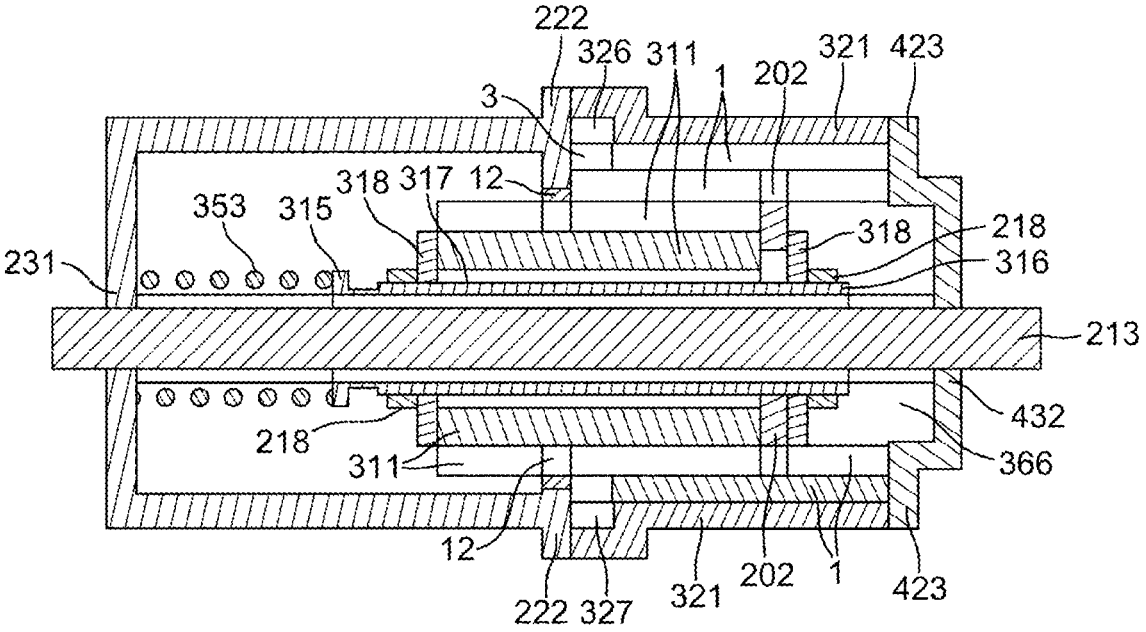
FIG. 18 is a cross-sectional view of the variable displacement gerotor pump of FIG. 17 in an assembled state.

The discharge pumping chamber 326 may be positioned at one end of the casing 321, and the fluid connection passage 329 may be formed between one end and the other end of the casing 321. The fixed gear 1 and the moving gear 311 should be rotated counterclockwise due to the discharge pumping chamber 326 and the fluid connection passage 329. The casing cover 423 may be blocked so as to confine the fluid, except for the moving gear shaft support device 432 and a fluid connection passage 430 through which the moving gear shaft 213 passes. As shown in FIG. 18, a hydraulic chamber 366 may be surrounded by the fixed gear 1 and the gear block 202, and may confine the fluid in the right space with reference to the gear block 202 where the moving gear 311 is not located. The fluid connection passage 430 may be connected to the fluid connection passage 329 inside the casing 321 to allow the fluid to flow. The method of allowing the fluid to flow between the discharge pumping chamber 326 and the hydraulic chamber 366 is not limited to using the fluid connection passages 329, 430.

In addition, the method shown in FIG. 13 may be used as a modified method relating to driving of the moving gear 311. In addition, the moving gear 211 and the moving gear shaft 213 of the method shown in FIG. 11 may be used, or one moving gear sleeve 215 may be removed and then the moving gear 211 may be used. However, the above method may be one of the examples relating to driving of the moving gear 311.

The moving gear 311 may include the moving gear hole 314 with the spline gear formed therein, and may be the moving gear common shaft 317 and the moving gear shaft 213 having the moving gear common shaft sleeves 315, 316 at both ends. As a result, the moving gear 311 may be rotated through the moving gear shaft 213 and the moving gear 311 may be moved in the axial direction through the moving gear common shaft 317.

FIG. 18 is a cross-sectional view of the variable displacement gerotor pump of FIG. 17 in an assembled state. The hydraulic chamber 366 of the variable displacement gerotor pump may be surrounded by the fixed gear 1, the gear block 202, and the casing cover 423. The hydraulic pressure of the pumping chamber 326 for discharging the fluid of the variable displacement gerotor pump, the fluid connection passages 329, 430, and the hydraulic chamber 366 may be always maintained the same. The configuration and effect, operating principle, and the like of the gear block 202 may be the same as those shown in FIGS. 15 and 16.

The variable displacement gerotor pump shown in FIGS. 17 and 18 can maintain the hydraulic pressure of the discharge pumping chamber and the discharge per unit time within a certain range by adjusting the restoring force of the spring 353.

The variable displacement gerotor pump according to the various embodiments described above can be used to keep the flow of fluid constant or to keep the hydraulic pressure constant, in an environment in which the rotational speed of the shaft changes frequently with a large width, such as in oil pump or an air conditioner pump in an automobile. In addition, the variable displacement gerotor pump can be used as a pump in a place where there is a large change in flow rate. In addition, the variable displacement gerotor pump may be used as an endless power distribution device in a caterpillar vehicle, where it is necessary to change a direction by changing the speed of each of the left and right wheels in rotation. In a general automobile, when the driving wheels on both left and right sides are connected to respective hydraulic motors, the variable displacement gerotor pump can actively realize the left and right differential operation according to the direction change of the automobile. In addition, the variable displacement gerotor pump may be used in a hydraulic system to easily implement changes in flow rate and hydraulic pressure, and the variable displacement gerotor motor having the same or similar configuration can easily implement a change in torque and may also be used to implement a continuously variable transmission.

It should be understood that the embodiments of the present disclosure described above are disclosed for the purpose of illustration, and those skilled in the art with ordinary knowledge of the present disclosure will be able to make various modifications, changes and additions within the spirit and scope of the present disclosure, and such modifications, changes and additions are within the scope of the claims.

The invention claimed is:

1. A variable displacement gerotor pump, comprising;

a casing including at least one pumping chamber disposed inside of the casing and located at one end of the casing and having at least one fluid inlet that penetrates through the casing and located at the one end of the casing;

a fixed gear being inserted into the casing and rotating at a fixed position, having a shape of a cylinder, including a plurality of teeth formed inside the cylinder, and including at least one fluid hole at one end of the cylinder to allow a fluid to flow from or into the at least one pumping chamber;

a moving gear provided inside the fixed gear and in mesh with the fixed gear and movable in an axial direction, the moving gear including one less number of teeth than a number of teeth of the fixed gear;

a gear block arranged entirely inside the fixed gear, the gear block comprising one side and the other opposing side, and the one side of the gear block being in contact with one end of the moving gear such that a fluid leakage is prevented between the gear block and the moving gear because of the contact therebetween, wherein the gear block is movable in the axial direction with the moving gear;

a gear ring defining an opening therein, wherein the moving gear is configured to move in the axial direction through the opening in the gear ring; and a gear ring cover attached to and provided at the one end of the casing and including a hole, wherein the gear ring is disposed in the hole such that an outer peripheral surface of the gear ring contacts an inner peripheral surface of the gear ring cover so that a fluid leakage is prevented between the gear ring cover and the gear ring because of the contact therebetween, the gear ring being rotatable in the hole, wherein one end of the fixed gear is in contact with both the gear ring cover and the gear ring, and wherein the at least one fluid hole of the fixed gear penetrates through the fixed gear and directly communicates with the at least one pumping chamber during at least a portion of a cycle of rotation of the fixed gear so that the fluid flows from or into the at least one pumping chamber when the moving gear rotates.

2. The variable displacement gerotor pump according to claim 1, further comprising:

a drive flange connected to the fixed gear and configured to rotate the fixed gear.

* * * * *